US007229730B2

(12) United States Patent
Ohira et al.

(10) Patent No.: US 7,229,730 B2
(45) Date of Patent: Jun. 12, 2007

(54) PROCESS FOR PRODUCING NEGATIVE-CHARGING ELECTROPHOTOGRAPHIC PHOTOSENSITIVE MEMBER, NEGATIVE-CHARGING ELECTROPHOTOGRAPHIC PHOTOSENSITIVE MEMBER, AND ELECTROPHOTOGRAPHIC APPARATUS USING SAME

(75) Inventors: Jun Ohira, Sunto-gun (JP); Satoshi Kojima, Mishima (JP); Makoto Aoki, Yokohama (JP); Kazuto Hosoi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/340,729

(22) Filed: Jan. 27, 2006

(65) Prior Publication Data

US 2006/0127783 A1 Jun. 15, 2006

Related U.S. Application Data

(63) Continuation of application No. PCT/JP05/015387, filed on Aug. 18, 2005.

(30) Foreign Application Priority Data

Aug. 19, 2004 (JP) ..... 2004-239490
Aug. 5, 2005 (JP) ..... 2005-227750

(51) Int. Cl.
*G03G 5/14* (2006.01)

(52) U.S. Cl. ..... 430/66; 430/67; 430/128; 430/132

(58) Field of Classification Search ..... 430/66, 430/67, 128, 132, 131; 399/159
See application file for complete search history.

(56) References Cited

U.S. PATENT DOCUMENTS

| | | | | |
|---|---|---|---|---|
| 5,430,526 | A * | 7/1995 | Ohkubo et al. | 399/159 |
| 6,435,130 | B1 * | 8/2002 | Takaki et al. | 118/723 E |
| 2003/0104293 | A1 * | 6/2003 | Okamura et al. | 430/57.4 |
| 2004/0071890 | A1 * | 4/2004 | Hashizume et al. | 427/408 |
| 2004/0121250 | A1 * | 6/2004 | Kojima et al. | 430/56 |
| 2004/0209179 | A1 * | 10/2004 | Hosoi et al. | 430/57.4 |

* cited by examiner

*Primary Examiner*—Janis L. Dote
(74) *Attorney, Agent, or Firm*—Fitzpatrick, Cella, Harper & Scinto

(57) ABSTRACT

The invention provides a process for producing a negative-charging electrophotographic photosensitive member which can improve the adherence between a first layer and a second layer without lowering the effect of lessening image defects and realize a reduction in overall costs, a negative-charging electrophotographic photosensitive member produced by the process, and an electrophotographic apparatus. In the process for producing a negative-charging electrophotographic photosensitive member, a first layer is deposited on a substarte, at least the vertexes of protuberances are removed, the substrate with the first layer deposited theron is placed in a film forming furnace, the first layer surface is plasma-treated with a gas containing at least a Group 13 element in the periodic table and a dilution gas composed of at least one selected from hydrogen, argon and helium, and a layer formed of a non-single-crystal material is deposited as the second layer on the first layer.

11 Claims, 6 Drawing Sheets

PROCESS FOR PRODUCING NEGATIVE-CHARGING ELECTROPHOTOGRAPHIC PHOTOSENSITIVE MEMBER, NEGATIVE-CHARGING ELECTROPHOTOGRAPHIC PHOTOSENSITIVE MEMBER, AND ELECTROPHOTOGRAPHIC APPARATUS USING SAME

This application is a continuation of International Application No. PCT/JP2005/015387, filed Aug. 18, 2005, which claims the benefit of Japanese Patent Applications No. 2004-239490, filed Aug. 19, 2004 and No. 2005-227750, filed Aug. 5, 2005.

BACKGROUND OF THE INVENTION

1. Field of the Invention

This invention relates to a process for producing a negative-charging electrophotographic photosensitive member which can reduce image defects and maintain good image formation over a long period of time, and also relates to a negative-charging electrophotographic photosensitive member and an electrophotographic apparatus.

2. Related Background Art

Materials that form photoconductive layers in solid-state image pick-up devices or in electrophotographic photosensitive members in the field of image formation or in character readers are required to have properties as follows: They are highly sensitive, have a high SN ratio [photocurrent (Ip)/dark current (Id)], absorption spectra suited to spectral characteristics of electromagnetic waves to be applied, high response to light, and desired dark resistance, and are harmless to human bodies when used, and also in the solid-state image pick-up devices, have properties of easily erasing afterimages in a prescribed period of time. In particular, in the case of electrophotographic photosensitive members used in business machines in offices, harmlessness in use is important.

Materials that attract notice from such viewpoints include amorphous silicon (hereinafter "a-Si") whose dangling bonds have been modified with monovalent elements such as hydrogen or halogen atoms, and it is applied to electrophotographic photosensitive members.

As processes by which electrophotographic photosensitive members composed of a-Si are formed on conductive substrates, many processes are known in the art, as exemplified by sputtering, a process in which source gases are decomposed by heat (thermal CVD), a process in which source gases are decomposed by light (photo-assisted CVD) and a process in which source gases are decomposed by plasma (plasma-assisted CVD). In particular, the plasma-assisted CVD (chemical vapor deposition), i.e., a process in which source gases are decomposed by direct-current or high-frequency or microwave glow discharge to form deposited films on the conductive substrate has been put into practical use in a very advanced state at present in the field of processes of forming electrophotographic photosensitive members. As the layer construction of such deposited films, the following are proposed: electrophotographic photosensitive members composed primarily of a-Si and modification elements added appropriately, as conventionally done, and in addition thereto those constructed to have an upper-part blocking layer or a surface protective layer, having blocking power, which is further deposited on the surface side (see, e.g., Japanese Patent Application Laid-open No. H08-15882). This Japanese Patent Application Laid-open No. 08-15882 discloses a photosensitive member provided between a photoconductive layer and a surface protective layer with an upper-part blocking layer having carbon atoms in a smaller content than the surface protective layer and incorporated with atoms capable of controlling conductivity.

The a-Si films have such a disposition that, where any dust of the order of micrometers have adhered to the substrate surface, the films may undergo abnormal growth on the dust serving as nuclei during film formation and protuberances come to grow. These protuberances cause image defects on images. In order to prevent such image defects, a technique is proposed in which the vertexes of protuberances present on the photosensitive member surface after film formation are flattened by polishing (see, e.g., Japanese Patent Application Laid-open No. 2001-318480). This Japanese Patent Application Laid-open No. 2001-318480 discloses a post-treatment method in which an electrophotographic photosensitive member is held and rotated and, while a polishing tape wound around an elastic roller and the surface of the photosensitive member are brought into pressure contact, the polishing tape is allowed to travel, carrying out polishing to flatten the protuberances of the photosensitive member surface.

An example of the protuberances is shown in FIG. 1. Each protuberance 111 has the shape of a reversed cone whose vertex starts from dust 110, and has a disposition that it lowers electrical resistance because there are a very large number of localized levels at an interface 112 between a normal deposited portion and the protuberant portion, and allows electric charges to pass through the interface 112 toward the substrate side. Hence, the portion at which a protuberance is present appears as a white dot in solid black images (in the case of reverse development, appears as a black dot in solid white images). This image defect called "dot" has hitherto not been regarded as a defective depending on size even when several dots are present in an A3-size sheet. However, further improvement in quality is required where the photosensitive member is to be mounted to a color copying machine, and even when only one dot is present in a A3-size sheet, it regarded as a defective. Such protuberances are originated from dust, and hence substrates to be used are strictly cleaned before films are formed thereon, where the steps of setting the substrates in a film forming apparatus are all operated in a clean room or in vacuum. In this way, efforts have been made so as to lessen as far as possible the dust which may adhere to the substrate surface before the film formation is started, and a certain effect have been obtained.

However, the cause of the occurrence of protuberances is not only the dust having adhered to the substrate surface. That is, where a-Si electrophotographic photosensitive members are produced, the layer thickness required is as very large as several micrometers to tens of micrometers, and hence the film formation time reaches several hours to tens of hours. During such film formation, the a-Si becomes deposited not only on the substrates, but also on walls of the film forming furnace and on components inside the film forming furnace. The deposits on the furnace walls and components are not filmy ones deposited on the substrate but powdery deposits. In some cases, they may have weakly adhered to cause film come-off during film formation carried out over a long time. Once even any slight film has come off during film formation, it causes dust, and the dust adheres to the surface of a photosensitive member under deposition so that starting from the dust, the protuberances come about which are abnormal-growth portions. Accordingly, in order to maintain a high yield, polishing is carried out to flatten the protuberances formed by abnormal growth, and an upper-part blocking layer having the ability to block the acquired electric charges is so deposited as to cover the flattened protuberances to prevent such a phenomenon that the acquired electric charges leak through protuberant portions or the interfaces between normal portions and the protuberant portions. Such a measure has been taken, and a certain effect have been obtained (see, e.g., Japanese Patent Application Laid-open No. 2004-133396).

As methods for charging a-Si photosensitive members electrostatically, they include a corona charging system making use of corona charging, a roller charging system making use of a conductive roller to perform charging by direct discharge, and an injection charging system in which the contact area is sufficiently taken up using magnetic particles or the like and electric charges are directly injected to the photosensitive member surface to perform charging. In particular, the corona charging system and the roller charging system make use of discharge, and hence discharge products tend to adhere to the photosensitive member surface. In addition, the a-Si photosensitive members have a surface layer having much higher hardness than organic photosensitive members and the like, and hence the discharge products are apt to remain on the surface, so that the discharge products and water content may combine due to the adsorption of water content in a high humidity environment to bring the surface into a low resistance, where electric charges at the surface tend to move to cause a phenomenon of image deletion in some cases. Accordingly, it has been necessary in some cases to take various measures on how to rub the surface, how to manage the temperature of photosensitive members, and so forth.

On the other hand, the injection charging system is a charging system in which any discharge is not intentionally used and electric charges are directly injected from the part coming into contact with the photosensitive member surface, and hence it can not easily cause the phenomenon such as image deletion. Also, the injection charging system, which is a contact charging system, is of a voltage control type, while the corona charging system is of a current control type, and the former has such an advantage that any non-uniformity of charge potential can be rendered relatively small. In a conventional injection charging system, a contact charging member having particles in the form of a magnetic brush, composed of a magnetic material and magnetic particles, is brought into contact with the photosensitive member surface to achieve the improvement of charging performance (see, e.g., Japanese Patent Application Laid-open No. H08-6353).

SUMMARY OF THE INVENTION

Such conventional processes for producing electrophotographic photosensitive members can produce electrophotographic photosensitive members having performance and uniformity which are practical to a certain extent.

However, requirements for preventing image defects have become severer year by year toward higher image quality in color copying machines, and it is desired to provide an electrophotographic photosensitive member having a higher quality.

The injection charging system have various advantages as stated above, but, e.g., with a contact injection charging system making use of a magnetic-brush charging assembly, the magnetic brush rubs the photosensitive member surface directly, and hence it is necessary to produce an electrophotographic photosensitive member having the good adherence between layers, under careful management of how to form the upper-part blocking layer and the surface layer.

Accordingly, where, as conventionally done, a photosensitive member is set again in a film forming furnace after the polishing is carried out to flatten the protuberances and then the upper-part blocking layer is deposited as a second layer, a problem may arise such that the low mutual adherence between layers may result. This problem is caused by the layer configuration in which, where a protective layer deposited for the purpose of preventing the photosensitive member from being scratched by the polishing and the upper-part blocking layer are formed as layers formed of a non-single-crystal material containing at least carbon and silicon, an upper-part blocking layer having a relatively low carbon content is deposited after a protective layer having a relatively high carbon content has been deposited. It is considered that the adherence between layers becomes low for the reason that the layer having a low carbon content is deposited after the layer having a high carbon content has been deposited.

After the upper-part blocking layer has been deposited, it is also necessary to further deposit the surface protective layer as the second layer in order to protect the photosensitive member surface. This has caused a rise in cost of the whole.

In order that any low-adherence joint coming from the fact that the layer having a relatively low carbon content is deposited after the layer having a relatively high carbon content is deposited, is not provided so as to maintain the adherence between layers, and also in order not to cause a rise in cost of the whole, it is desired to provide a photosensitive member production process by which the surface protective layer can be deposited without depositing the upper-part blocking layer to cover the protuberances having been flattened and also the ability to block the electric charges can be endowed.

The present inventors have conducted exhaustive researches in order to solve the above problems. As a result, they have discovered that a negative-charging electrophotographic photosensitive member having a photoconductive layer formed of a non-single-crystal material can be produced as described below, thereby realizing stable and inexpensive production of the photosensitive member without adversely affecting any electrical properties, the adherence between layers, and image defect lessening effect. Thus, they have accomplished the present invention.

More specifically, the present invention is concerned with a process for producing a negative-charging electrophotographic photosensitive member having a layer formed of a non-single-crystal material; the process comprising the steps of:

as a first step, placing a cylindrical substrate having a conductive surface in a film forming furnace connected to evacuation means, having a source gas feed means and capable of being made vacuum-airtight, and decomposing a source gas by high-frequency power to deposit on the substrate a photoconductive layer formed of at least a non-single-crystal material as a first layer;

as a second step, first taking out of the film forming furnace the substrate on which the first layer has been deposited, and then;

as a third step, removing protuberances at least at their vertexes on the surface of the first layer deposited in the first step;

as a fourth step, placing the substrate having been subjected to the third step in a film forming furnace having an evacuation means and a source gas feed means and capable of being made vacuum-airtight, and subjecting the surface of the first layer to plasma treatment with a gas containing at least one Group 13 in the periodic table and a dilution gas composed of at least one selected from the group consisting of hydrogen, argon and helium; and as a fifth step, decomposing at least a source gas by high-frequency power to deposit on the first layer a layer formed of a non-single-crystal material as a second layer.

The first layer may also be provided with an upper-part blocking layer containing at least one Group 13 element in the periodic table. This is preferable in view of the improvement of electrical properties. Also, the upper-part blocking layer may be so formed that the compositional ratio of carbon to silicon which constitute that layer increases toward the surface side. This is preferable in view of the control of potential non-uniformity. Then, the upper-part blocking layer may be so formed that the Group 13 element in the periodic table is in a content of from 100 atomic ppm or more to 30,000 atomic ppm or less based on the total number of constituent elements contained in that layer. This is desirable in view of electrical properties.

The first layer may be provided with a protective layer containing at least silicon, formed on the outermost surface of the first layer. This is preferable in view of scratch resistance in the step of removing protuberances at least at their vertexes.

Further, in the third step, the step of processing protuberances on the first-layer surface to remove at least their vertexes may be polishing. This is preferable in view of workability and uniformity.

Still further, the temperature set to heat the substrate may be changed between the third step and the fourth step, and treatment to bring the surface into contact with water may further be carried out between the third step and the fourth step. This brings about the improvement of the adherence between layers in depositing the second layer, and increases the latitude in film come-off.

Still further, in the fourth step, the Group 13 element in the periodic table in the whole gas to be fed may be in a content of from $2.0\times10^{-4}$ mol % or more to $2.0\times10^{-2}$ mol % or less. This is preferable in order to lessen image defects. As the gas containing the Group 13 element in the periodic table as used in the fourth step, $B_2H_6$ is preferred in view of handling.

The present invention is also a negative-charging electrophotographic photosensitive member characterized in that, in an electrophotographic photosensitive member comprising a cylindrical substrate having at least a conductive surface, a first layer formed thereon comprising a photoconductive layer formed of at least a non-single-crystal material, an upper-part blocking layer formed of a non-single-crystal material containing carbon and silicon and a protective layer, and a second layer formed on the first layer of at least a non-single-crystal material, an abnormal-growth portion in the first layer does not reach the second layer, and the content distribution of the Group 13 element in the periodic table has a peak in the interfacial region between the first layer and the second layer. Also, the compositional ratio of carbon to silicon which constitute the upper-part blocking layer increases toward the surface side. This is preferable in view of the control of potential non-uniformity. Further, the peak of the content distribution of the Group 13 element in the periodic table in the interfacial region between the first layer and the second layer corresponds to from $5.0\times10^{17}$ atoms/cm$^3$ or more to $1.0\times10^{21}$ atoms/cm$^3$ or less. This is preferable in view of reduction in image defects and electrical properties.

As described above, according to the negative-charging electrophotographic photosensitive member production process of the present invention, it has the step of plasma treatment which forms an interface having the ability of blocking the acquired electric charges, at the surfaces of the protuberances at least the vertexes of which have been removed, thereby making it unnecessary to deposit an upper-part blocking layer as a second layer and achieving the improvement of the adherence between layers while maintaining the effect of lessening image defects. The simplification of film forming steps is also concurrently achieved to realize a reduction in overall costs. Also, inasmuch as the compositional ratio of carbon to silicon which constitute the upper-part blocking layer deposited as the first layer increases toward the surface side, potential non-uniformity can be controlled.

DESCRIPTION OF THE PREFERRED EMBODIMENTS

The present inventors have made studies to find a remedy for image defects coming from the protuberances, which cause an important problem in the photosensitive members formed of a non-single-crystal material, in particular, the a-Si photosensitive members. In particular, they have made all efforts to find how to prevent image defects due to the protuberances caused by film come-off from walls of the film forming furnace and from components inside the film forming furnace in the course of film formation.

Figure 1:
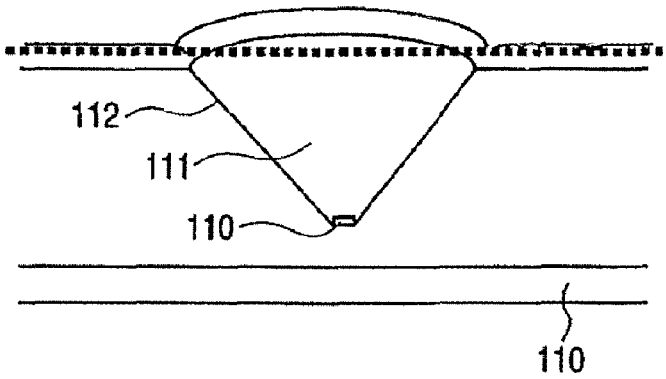
FIG. 1 is a diagrammatic sectional view showing an example of protuberances of an electrophotographic photosensitive member.
Figure 2:
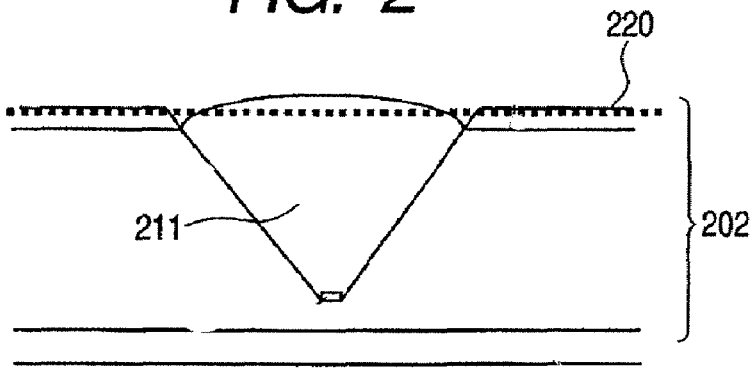
FIG. 2 is a diagrammatic sectional view showing an example of the electrophotographic photosensitive member of the present invention in which the surface of the first layer has been subjected to polishing.
Figure 3:
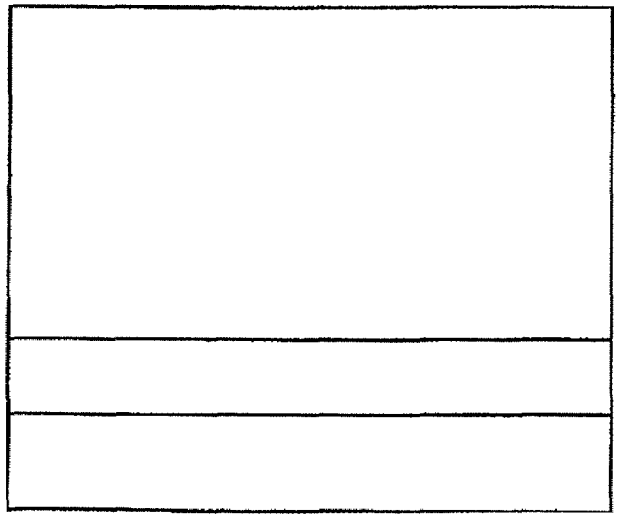
FIG. 3 is a diagrammatic sectional view showing an electrophotographic photosensitive member in which layers up to the first layer have been deposited.

The reason why the protuberances appear as image defects like dots is that there are many localized levels at the abnormal-growth portions, i.e., the protuberant portions, and at the interfaces between a normal deposition portion and the protuberant portions, where resistance is reduced, and acquired electric charges pass through the protuberant portions and interfaces to leak toward the substrate side. However, the protuberances caused by the dust having adhered during film formation grow from the middle of the deposited film, not from the substrate. Hence, if the surface side is covered with a portion having a blocking ability, the acquired electric charges can be prevented from entering the protuberances, and the protuberances would not cause image defects even if they are present. Specifically, as shown in FIG. 2, the portion having blocking ability may be formed after a first layer 202 has been deposited and thereafter the vertexes of protuberances 211 have been removed to flatten their surfaces.

A method is used at present in which a layer including an upper-part blocking layer and a surface protective layer is deposited as a second layer. This method has the effect of lessening image defects. However, a problem has been raised in that the adherence between layers becomes low for the reason that the layer having a low carbon content is deposited after the layer having a high carbon content has been deposited. Also, after the upper-part blocking layer has been deposited, the surface protective layer must further be deposited for the purpose of protecting the photosensitive member. This has resulted in a rise in cost as a whole.

Accordingly, the present inventors have conducted exhaustive researches to establish a plasma treatment method by which, without depositing the upper-part blocking layer as the second layer, an interface having the ability to block the acquired electric charges can be formed between the first layer and the second layer, and have found that by depositing only the surface protective layer as the second layer, the effect of lessening the image defects is exhibited. The reason therefor is presumed to be that the protuberances is subjected to a process of removing at least their vertexes, and the protuberance surfaces exposed on the photoconductive layer surface are modified in the order of several atoms by the plasma treatment into the interface having the ability to block the acquired electric charges, and hence the acquired electric charges can be prevented from entering the protuberances.

Thus, instead of the conventional upper-part blocking layer (the second layer), the interface having the ability to block the acquired electric charges can be formed at each protuberance surface flattened. This enables the adherence between layers to be prevented from lowering due to the upper-part blocking layer (the second layer) deposited otherwise, and makes it unnecessary to deposit the upper-part blocking layer (the second layer), whereby the total costs can be cut down.

In regard to the combination of electrophotographic apparatus and electrophotographic photosensitive members, the present inventors have also conducted exhaustive researches on various electrophotographic processes and various photosensitive member production conditions in combination, in order to achieve further high image quality and high running performance.

In regard to the electrophotographic apparatus making use of the electrophotographic photosensitive member of the present invention, they have found that, in the contact charging system making use of a magnetic-brush charging assembly, the surface potential fall of the electrophotographic photosensitive member can be reduced because the system is of a voltage control type, and potential non-uniformity is difficult to bring about. Hence, it has been found that the electrophotographic photosensitive member constituted as in the present invention can realize both the prevention of potential non-uniformity and the high running performance free of separation of layers.

The present invention is described below in detail with reference to the accompanying drawings as needed.

a-Si Photosensitive Member According to the Invention

Figure 4:
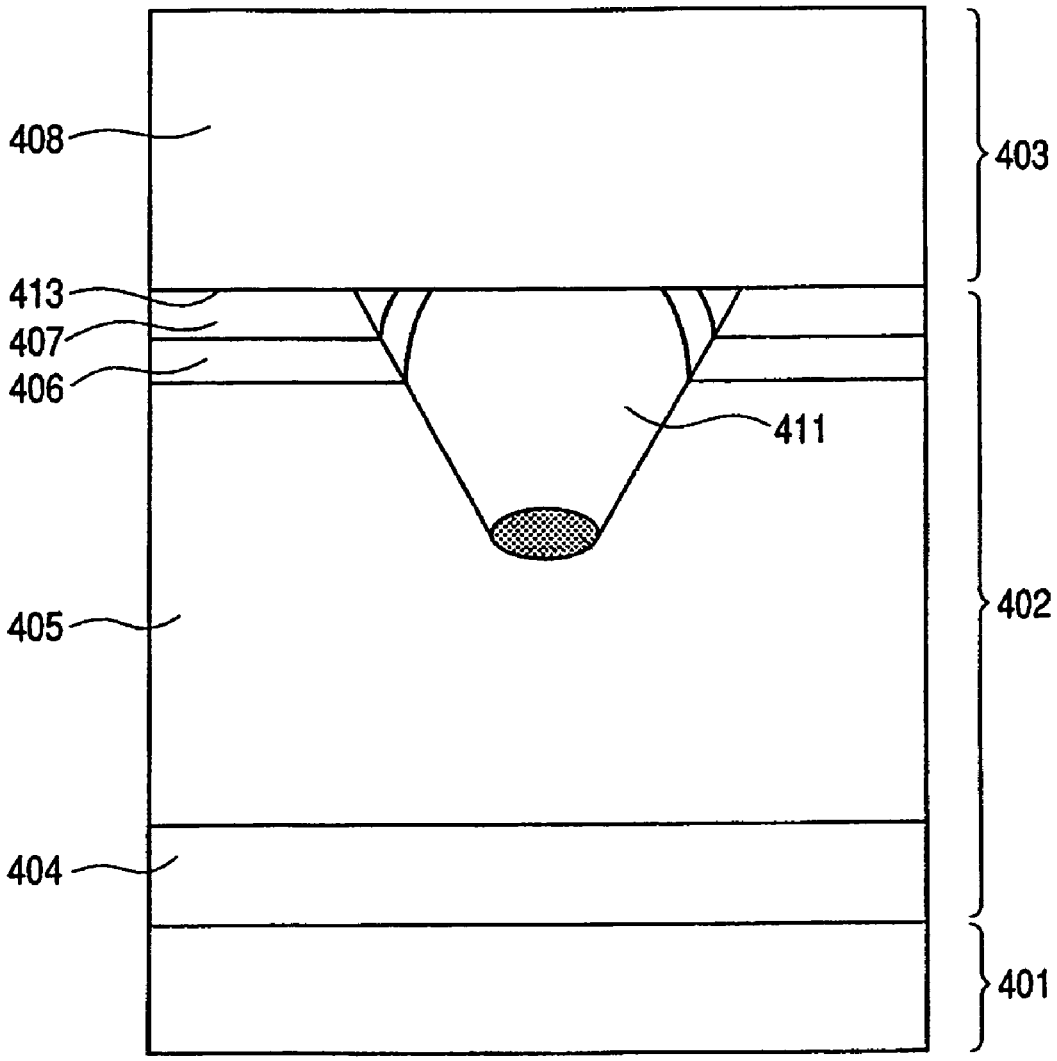
FIG. 4 is a diagrammatic sectional view showing an example of the negative-charging electrophotographic photosensitive member of the present invention.
Figure 9:
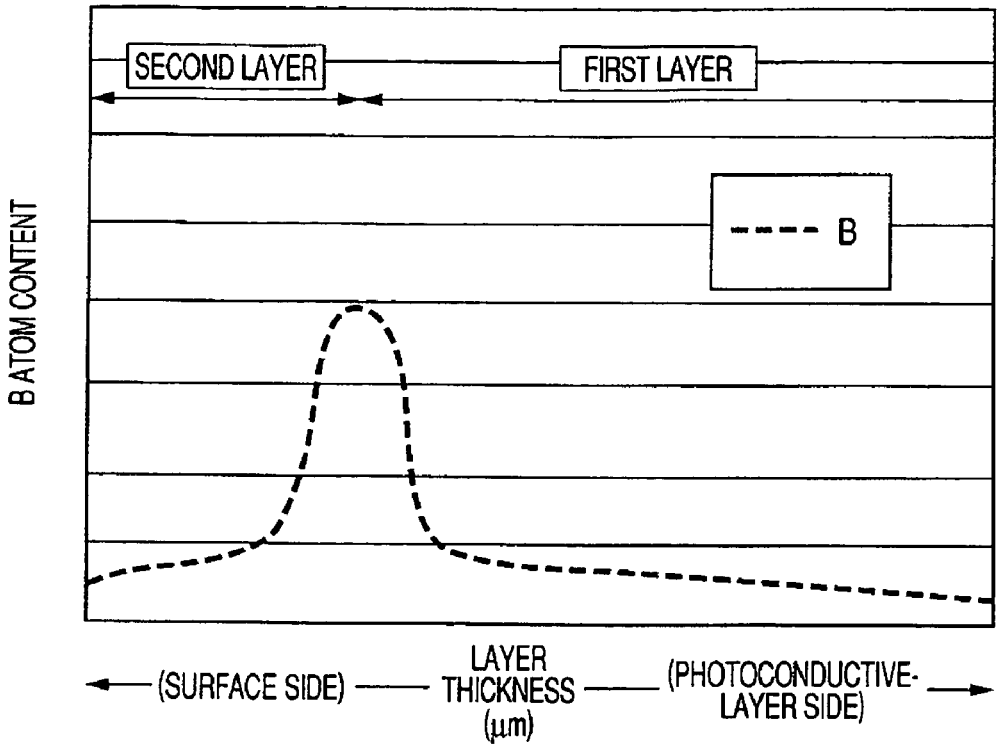
FIG. 9 is a graph showing content distribution of a Group 13 element (boron atoms) in the periodic table in the negative-charging electrophotographic photosensitive member of the present invention.
Figure 10:
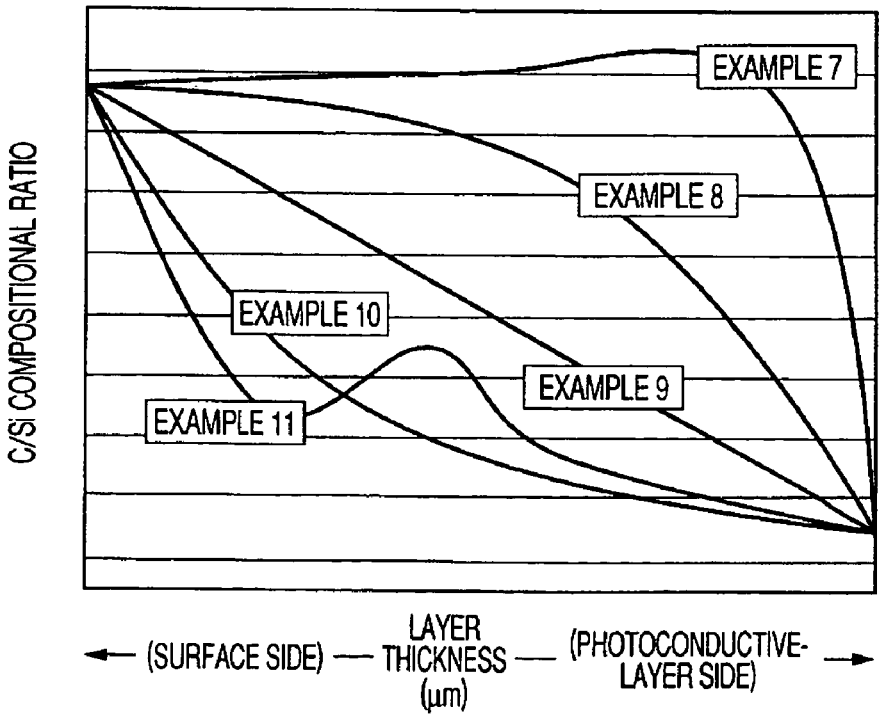
FIG. 10 is a graph showing how to change the compositional ratios of carbon to silicon which constitute the upper-part blocking layer in the present invention.

An example of the layer construction of the electrophotographic photosensitive member according to the present invention is shown in FIG. 4; the content distribution of a Group 13 element of the periodic table (boron atoms) in the negative-charging electrophotographic photosensitive member of the present invention, in FIG. 9; and a graph showing how change the compositional ratios of carbon to silicon which constitute the upper-part blocking layer in the present invention, in FIG. 10.

The electrophotographic photosensitive member of the present invention is one obtained through the steps of:

as a first step, placing a substrate 401 made of a conductive material as exemplified by aluminum or stainless steel, in a film forming furnace connected to an evacuation means, having a source gas feed means and capable of being made vacuum-airtight, and decomposing source gases by high-frequency power to deposit on the substrate a photoconductive layer 405 formed of at least a non-single-crystal material as a first layer 402;

as a second step, first taking out of the film forming furnace the substrate on which the first layer 402 has been deposited, and then;

as a third step, removing protuberances 411 at least at their vertexes on the surface of the first layer 402 deposited in the first step;

as a fourth step, placing the substrate having been subjected to the third step in a film forming furnace having an evacuation means and a source gas feed means and capable of being made vacuum-airtight, to subject the first-layer 402 surface to plasma treatment with a gas containing at least one Group 13 element in the periodic table and a dilution gas composed of at least one selected from hydrogen, argon and helium; and as a fifth step, decomposing at least source gases by high-frequency power to deposit on the first layer a layer formed of a non-single-crystal material as a second layer 403.

By the film formation thus carried out, the surfaces of the protuberances 411 which had come from the interior of the first layer 402 and whose vertexes have been removed are modified into an interface having the ability to block the acquired electric charges. Thus, even if the protuberance 411 is present, it does not appear on images, making it possible to keep good image quality.

In the present invention, the first layer 402 comprises a photoconductive layer 405. As a material for the photoconductive layer 405, a-Si is used. Also, the first layer 402 may further be provided with a lower-part blocking layer 404 and an upper-part blocking layer 406. This is desirable in order to achieve good electrical properties.

The upper-part blocking layer 406 is commonly incorporated with a Group 13 element to have rectifying properties. This is desirable in view of the improvement of electrical properties.

A protective layer 407 may also be deposited on the first layer 402. This enables the step of removing the vertexes of protuberances 411 to be carried out without scratching the photosensitive member surface when the process of removing the protuberances 411 at least at their vertexes is carried out in the third step.

In addition, the second layer 403 is a surface protective layer formed of at least a non-single-crystal material, and is a silicon carbide layer containing at least carbon atoms and silicon atoms, or a non-single-crystal material layer composed primarily of carbon atoms, e.g., an a-C(H) layer. This surface protective layer enables the electrophotographic photosensitive member to be improved in wear resistance or scratch resistance.

The photosensitive member according to the present invention is also characterized in that, as shown in FIG. 4, the abnormal-growth portion in the first layer does not reach the second layer, and, as shown in FIG. 10, the compositional ratio of carbon to silicon which constitute the upper-part blocking layer 406 increases toward the surface side, and also in that the content distribution of the Group 13 element in the periodic table has a peak in the interfacial region 413 between the first layer and the second layer. Also, the peak may correspond to from $5.0\times10^{17}$ atoms/cm$^3$ or more to $1.0\times10^{21}$ atoms/cm$^3$ or less. This is preferable in view of a decrease in image defects and the improvement of electrical properties. This value may be obtained by using a composition analyzer such as SIMS (secondary ion mass spectrograph). Here, a peak value in the interfacial region is obtained, and hence it is expressed as the absolute value, not as a proportion to other constituent elements.

Shape and Material of Substrate According to the Invention

The substrate 401 shown in FIG. 4 may have any desired shapes according to how the electrophotographic photosensitive member is driven.

For example, it may have the shape of a cylinder, the shape of a sheet or the shape of an endless belt, having smooth surface or uneven surface. Its thickness may appropriately be determined so that the electrophotographic photosensitive member can be formed as desired. Where flexibility suitable for electrophotographic photosensitive members is required, the substrate may be made as thin as possible as long as it can sufficiently function as a substrate. In view of production and handling and from the viewpoint of mechanical strength, however, the substrate may normally have a thickness of 0.5 μm or more in the shape of a cylinder and 10 μm or more in the shape of a sheet or an endless belt.

As materials for the substrate, conductive materials such as aluminum and stainless steel as mentioned above are commonly used. Also, materials may be used having no particular conductivity in themselves, such as various types of plastic or glass, and provided with conductivity by vacuum deposition or the like of the following conductive material on their surfaces at least on the side where the photoconductive layer is to be formed.

The conductive material may include, besides the foregoing, metals such as Cr, Mo, Au, In, Nb, Te, V, Ti, Pt, Pd and Fe, and alloys of any of these.

The plastic may include films or sheets of polyester, polyethylene, polycarbonate, cellulose acetate, polypropylene, polyvinyl chloride, polystyrene or polyamide.

First Layer According to the Invention

The first layer 402 shown in FIG. 4 is constituted of a non-single-crystal material composed primarily of silicon atoms and further containing hydrogen atoms and/or halogen atoms (hereinafter abridged "a-Si(H,X)").

The photoconductive layer 405 may be formed by plasma-assisted CVD, sputtering, ion plating or the like. Films prepared by the plasma-assisted CVD are preferred because films having especially high quality can be obtained. This process may be carried out using, as source gases, gaseous or gasifiable silicon hydrides (silanes) such as $SiH_4$ $Si_2H_6$, $Si_3H_8$ and $Si_4H_{10}$, and decomposing these gases by means of high-frequency power. In view of easiness in handling for layer formation and good Si-feeding efficiency, $SiH_4$ and $Si_2H_6$ may be cited as preferred ones.

Here, the substrate temperature may preferably be kept at temperature of approximately from 200° C. to 450° C., and more preferably from 250° C. to 350° C., in view of characteristics. This is to accelerate the surface reaction at the substrate surface to sufficiently effect structural relaxation.

The pressure inside the reactor may similarly appropriately be selected within an optimum range in accordance with layer designing. In usual cases, it may be set at from $1\times10^{-2}$ to $1\times10^{3}$ Pa, and preferably from $5\times10^{-2}$ to $5\times10^{2}$ Pa, and more preferably from $1\times10^{-1}$ to $1\times10^{2}$ Pa.

In any of these gases, a gas containing $H_2$ or halogen atoms may further be mixed in a desired quantity to form the film. This is preferred in order to improve characteristics. What is effective as source gases for feeding halogen atoms may include fluorine gas ($F_2$) and interhalogen compounds such as BrF, ClF, $ClF_3$, $BrF_3$, $BrF_5$, $IF_5$ and $IF_7$. It may also include silicon compounds containing halogen atoms, what is called silane derivatives substituted with halogen atoms, specifically including, e.g., silicon fluorides such as $SiF_4$ and $Si_2F_6$, as preferred ones.

Any of these source gases for feeding silicon atoms may optionally be diluted with a gas such as $H_2$, He, Ar or Ne when used.

There are no particular limitations on the layer thickness of the photoconductive layer 405. It may suitably be from about 15 to 50 μm taking production costs and so forth into account.

The upper-part blocking layer 406 may be formed, as in the photoconductive layer 405, by plasma-assisted CVD, sputtering, ion plating or the like. Films prepared by the plasma-assisted CVD are preferred because films having especially high quality can be obtained. As Si-feeding sources, gaseous or gasifiable silicon hydrides (silanes) such as $SiH_4$ $Si_2H_6$, $Si_3H_8$ and $Si_4H_{10}$may be used. In view of easiness in handling for layer formation and Si-feeding efficiency, $SiH_4$ and $Si_2H_6$ may be cited as preferred ones. Also, while the upper-part blocking layer may be satisfied if it is formed of at least a non-single-crystal material layer composed primarily of silicon atoms, a silicon carbide layer is preferred taking electrical properties into account. As carbon feeding sources used when the silicon carbide layer is formed, $CH_4$, $C_2H_2$, $C_2H_4$, $C_2H_6$, $C_3H_8$ and $C_4H_{10}$ may be used. In view of good C-feeding efficiency, $CH_4$, $C_2H_2$ and $C_2H_6$ may be cited as preferred ones.

The upper-part blocking layer 406 has the function of blocking electric charges from entering the first-layer 402 side from the surface side when the photosensitive member is subjected to charging in a certain polarity on its free surface, and exhibits no such function when subjected to charging in a reverse polarity. In order to provide such a function, it is necessary for the upper-part blocking layer 406 to be properly incorporated with impurity atoms capable of controlling conductivity. As the impurity atoms used for such purpose, a Group 13 element in the periodic table may be used in the present invention. The Group 13 element may specifically include boron (B), aluminum (Al), gallium (Ga), indium (In) and thallium (Tl). In particular, boron is preferred. The boron feeding source may include $BCl_3$, $BF_3$, $BBr_3$ and $B_2H_6$. $B_2H_6$ is preferred in view of easiness in handling.

The content of the impurity atoms capable of controlling conductivity which are to be incorporated in the upper-part blocking layer 406 can not absolutely be prescribed, as it depends on the composition of the upper-part blocking layer 406 and the manner of production. In general, such atoms may preferably be in a content of from 100 atomic ppm or more to 30,000 atomic ppm or less.

The atoms capable of controlling the conductivity which are contained in the upper-part blocking layer 406 may uniformly be distributed all over in the upper-part blocking layer 406, or may be contained in such a state that they are distributed non-uniformly in the layer thickness direction. In any case, however, in the in-plane direction parallel to the surface of the substrate, it is necessary for such atoms to be evenly contained in a uniform distribution so that the properties in the in-plane direction can also be made uniform.

In the upper-part blocking layer 406, the compositional ratio of carbon to silicon which constitute the upper-part blocking layer 406 may also be made to increase toward the surface side as shown in Table 10, from the photoconductive layer 405 side to a protective layer 407. This is more preferable in view of the control of potential non-uniformity.

The first layer 402 may also be formed in multiple layer construction in order to further improve characteristics. For example, the lower-part blocking layer 404 may commonly be formed of a-Si(H,X) as a base and may be incorporated with a Group 15 element in the periodic table (hereinafter also "Group 15 element"). This makes it possible to control the conductivity type and to provide the layer with the ability to block carriers from being injected from the substrate. In this case, at least one element selected from C, N and O may optionally be incorporated so that the stress can be adjusted and the function of improving adherence of the photoconductive layer 405 can be provided.

The element used as a dopant of the lower-part blocking layer 404 in the present invention may include the Group 15 element, and what may effectively be used as materials for incorporating the Group 15 element may include, as a material for incorporating phosphorus atoms, phosphorus hydrides such as $PH_3$ and $P2H_4$ and phosphorus halides such as $PF_3$, $PF_5$, $PCl_3$, $PCl_5$, $PBr_3$ and $PI_3$, and further $PH_4I$. Besides, the material for incorporating nitrogen atoms may include NO, $NO_2$, $N_2$ and $NH_3$ as effective as starting materials effective in incorporating the Group 15 element.

The dopant atoms may preferably be in a content of from $1\times10^{-2}$ to $1\times10^{4}$ atomic ppm, more preferably from $5\times10^{-2}$ to $5\times10^{3}$ atomic ppm, and most preferably from $1\times10^{-1}$ to $1\times10^{3}$ atomic ppm.

A protective layer 407 formed of at least a non-single-crystal material may also be provided on the outermost surface of the first layer 402 in the present invention. If the protective layer 407 is a non-single-crystal material layer composed primarily of silicon atoms, it is sufficient, but a silicon carbide layer is preferred taking electrical properties into account. This protective layer 407 enables the electrophotographic photosensitive member to be improved in wear resistance or scratch resistance.

As a discharge frequency used in plasma-assisted CVD when the first layer 402 is deposited, any frequencies may be used. In an industrial scale, it is preferred to use high-frequency power of from 1 MHz or more to less than 50 MHz, which is called an RF frequency band, and high-frequency power of from 50 MHz or more to 450 MHz or less, which is called a VHF band.

It is essential to remove the vertexes of the protuberances 411 present at the first layer 402 surface to flatten their surfaces. An example of a protuberance the vertex of which has been removed is shown in FIG. 2. The vertex may be removed up to a level line 220. This is preferable in view of reducing image defects and improving the adherence between layers. Also, a protuberance 211 with its vertex removed is exposed on the surface of the photoconductive layer because of the relation between the height of the protuberance 211 and the thickness of the first layer.

The vertexes may be removed by a means which dissolves them, such as alkali etching. However, polishing is preferred in view of workability and uniformity. Such polishing may be carried out using a surface polishing apparatus described later.

The electrophotographic photosensitive member in which up to the above step is completed may be subjected to treatment of bringing it into contact with water, before it is placed again in the film forming furnace. This is desirable in order to improve the adherence of the second layer 403 and lessen any dust having adhered. As a specific treating method, it is desirable to wipe the surface with clean cloth or paper, and it is more desirable to strictly clean the surface by washing with an organic solvent or by washing with water. In particular, in consideration for environment in recent years for environment, washing with water by means of a water washing system described later is more preferable.

Plasma Treatment According to the Invention

The plasma treatment according to the present invention is carried out in the following way: The discharge is stopped after the first layer has been formed, and the substrate with the first layer formed thereon is taken out of the film forming furnace, and after protuberances on the first layer surface are subjected to the process of removing at least their vertexes, is set in a film forming furnace capable of being made vacuum-airtight.

Specifically, plasma is generated in an atmosphere of a gas containing at least a Group 13 element in the periodic table and a dilution gas composed of at least one selected from hydrogen, argon and helium to carry out the treatment.

The surfaces of the protuberances whose vertexes have been removed, exposed on the surface of the photoconductive layer, have been modified in the order of several atoms as a result of this plasma treatment to afford the interface having the ability to block the acquired electric charges. Inasmuch as this interface can be formed between the first layer and the second layer, the effect of lessening image defects can be maintained even though any upper-part blocking layer is not deposited as the second layer. Also, inasmuch as it is no longer necessary to deposit any upper-part blocking layer as the second layer, the lowering of the adherence between layers can be prevented which may otherwise occur when the layer having a low carbon content is deposited after the layer having a high carbon content has been deposited.

The reason why the effect of lessening image defects can be maintained by this plasma treatment is presumed to be that the protuberance surfaces have been modified in the order of several atoms as a result of the plasma treatment to afford the interface having the ability to block the acquired electric charges, which enables the acquired electric charges to be prevented from entering the protuberances flattened.

This plasma treatment is carried out by placing the substrate on which the first layer has been deposited and the removal of the vertexes of protuberances has been carried out, in a film forming furnace capable of being made vacuum-airtight, and generating plasma in an atmosphere of a gas containing at least one Group 13 element in the periodic table and a dilution gas composed of at least one selected from hydrogen, argon and helium. As a discharge frequency used in plasma-assisted CVD when the plasma is generated, any frequencies may be used. In an industrial scale, it is preferable to use either of high-frequency power of from 1 MHz or more to less than 50 MHz, which is called an RF frequency band, and high-frequency power of from 50 MHz or more to 450 MHz or less, which is called a VHF band.

The gas containing a Group 13 element in the periodic table may include $BCl_3$, $BF_3$, $BBr_3$ and $B_2H_6$. $B_2H_6$ is preferred in view of easiness in handling. Boron atoms in the flow of all gases fed may be in a content of from $2.0\times10^{-4}$ mol % or more to $2.0\times10^{-2}$ mol % or less. This is preferable in view of the effect of lessening image defects and in view of electrical properties.

Second Layer According to the Invention

The second layer 403 according to the present invention, shown in FIG. 4, is deposited after the discharge is stopped once after the first layer 402 has been formed, then the substrate with the first layer 402 formed thereon is taken out of the film forming furnace, at least the vertexes of the protuberances on the first layer surface has been removes, and thereafter, the plasma treatment has been carried out.

The second layer 403 in the present invention is a surface protective layer 408 formed of at least a non-single-crystal material. This protective layer 408 enables the electrophotographic photosensitive member to be improved in wear resistance or scratch resistance.

The surface protective layer 408 may be formed, as in the photoconductive layer 405, by plasma-assisted CVD, sputtering, ion plating or the like. Films prepared by the plasma-assisted CVD are preferred because films having especially high quality can be obtained. As Si-feeding sources, gaseous or gasifiable silicon hydrides (silanes) such as $SiH_4$ $Si_2H_6$, $Si_3H_8$ and $Si_4H_{10}$may be used. In view of handling easiness in layer formation and Si-feeding efficiency, $SiH_4$ and $Si_2H_6$ may be cited as preferred ones. Also, the surface protective layer may preferably be a silicon carbide layer, whose matrix is silicon atoms, containing at least carbon atoms and silicon atoms, or a non-single-crystal material layer whose matrix is carbon atoms, e. g. an a-C(H) layer. As carbon feeding sources used here, $CH_4$, $C_2H_2$, $C_2H_4$, $C_2H_6$, $C_3H_8$ and $C_4H_{10}$ may be used. In view of good C-feeding efficiency, $CH_4$, $C_2H_2$ and $C_2H_6$ may be cited as preferred ones.

As a discharge frequency used in plasma-assisted CVD when the second layer 403 is deposited, any frequencies may be used. In an industrial scale, it is preferable to use either of high-frequency power of from 1 MHz or more to less than 50 MHz, which is called an RF frequency band, and high-frequency power of from 50 MHz or more to 450 MHz or less, which is called a VHF band.

The pressure inside the reactor may similarly appropriately be selected within an optimum range in accordance with layer designing. In usual cases, it may be set at from $1\times10^{-2}$ to $1\times10^{3}$ Pa, and preferably from $5\times10^{-2}$ to $5\times10^{2}$ Pa, and most preferably from $1\times10^{-1}$ to $1\times10^{2}$ Pa.

Further, the substrate temperature may appropriately be selected within an optimum range in accordance with layer designing. In usual cases, from the viewpoint of the improvement of the adherence between layers, it may preferably be set to be lower than the substrate temperature set when the first layer is formed. Specifically, where the silicon carbide layer is formed, it may preferably be set at 100° C. to 330° C., and more preferably from 150° C. to 270° C. In the case of the non-single-crystal material layer whose matrix is composed of carbon atoms, e.g., an a-C(H) layer, it may preferably be set at 20° C. or more to 50° C., preferably at about room temperature, e.g., at 25° C.

a-Si Photosensitive Member Film Forming Apparatus According to the Invention

Figure 5:
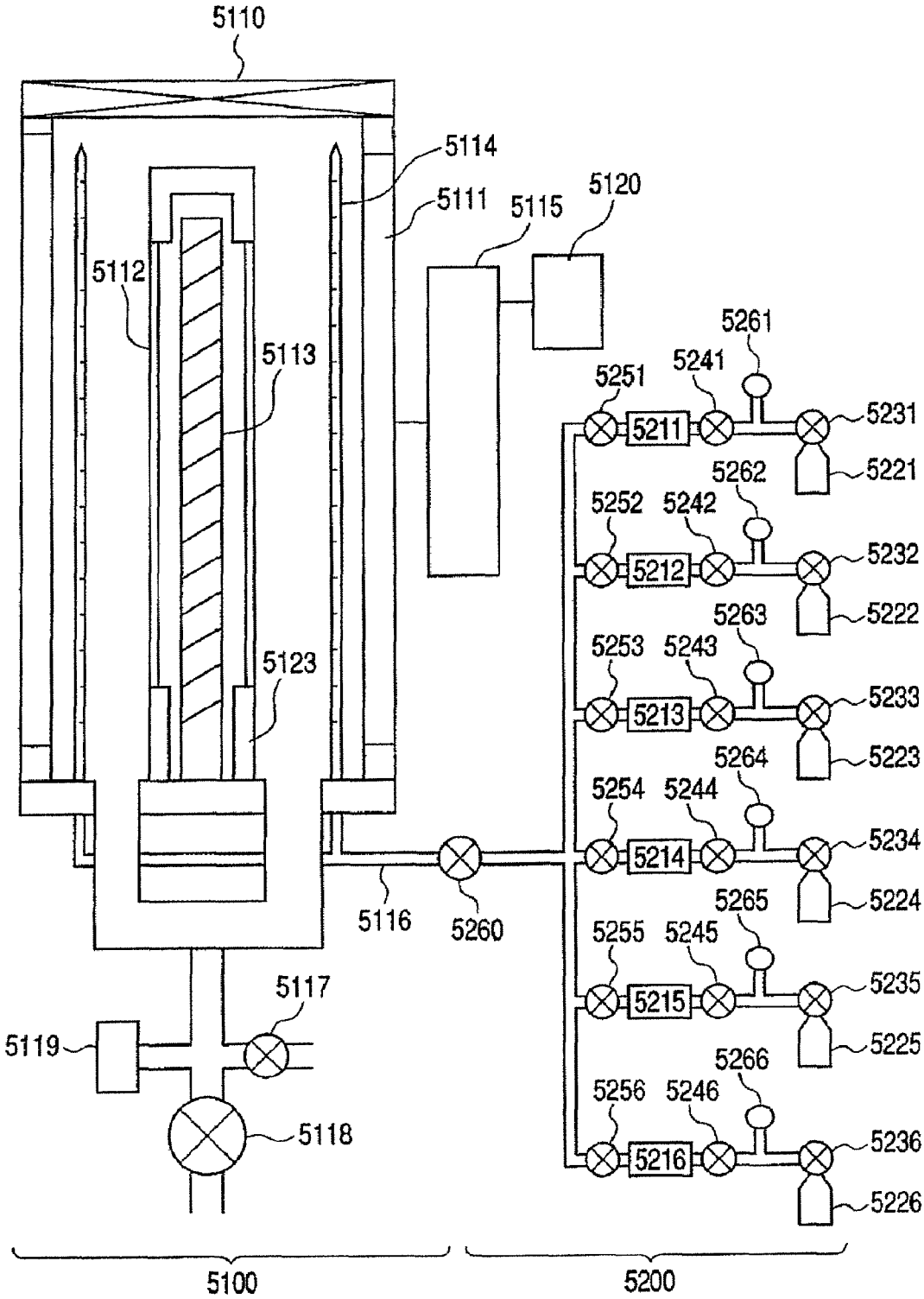
FIG. 5 is a diagrammatic sectional view of an a-Si photosensitive member film forming apparatus of an RF plasma CVD system.

FIG. 5 diagrammatically illustrates an example of an apparatus for forming films of the electrophotographic photosensitive member by an RF plasma-assisted CVD method using a high-frequency power source.

This apparatus is constituted primarily of a film forming system 5100, a source gas feed system 5200 and an exhaust system (not shown) for evacuating the inside of a film forming furnace 5110. The film forming furnace 5110 in the film forming system 5100 is provided with a substrate 5112 connected to the ground, a heater 5113 for heating the substrate, and a source gas feed pipe 5114. A high-frequency power source 5120 is further connected via a high-frequency matching box 5115.

The source gas feed system 5200 is constituted of gas cylinders 5221 to 5226 for source gases such as $SiH_4$, $H_2$, $CH_4$, NO, $B_2H_6$ and $CF_4$, valves 5231 to 5236, 5241 to 5246 and 5251 to 5256, and mass flow controllers 5211 to 5216. The gas cylinders for the respective constituent gases are connected to the gas feed pipe 5114 in the film forming furnace 5110 via a valve 5260.

The cylindrical substrate 5112 is set on a conductive supporting stand 5123 and is thereby connected to the ground.

An example of procedures of forming an electrophotographic photosensitive member by means of the apparatus shown in FIG. 5 is described below.

The substrate 5112 is set in the film forming furnace 5110, and the inside of the film forming furnace 5110 is evacuated by means of an exhaust device (e.g., a vacuum pump; not shown). Subsequently, the temperature of the substrate 5112 is controlled to be a desired temperature of from 200° C. to 450° C., preferably from 250° C. to 350° C., by means of the heater 5113 for heating the substrates. Next, in order that source gases for forming the photosensitive member are flowed into the film forming furnace 5110, gas cylinder valves 5231 to 5236 and a leak valve 5117 of the film forming furnace are checked to make sure that they are closed, and also flow-in valves 5241 to 5246, flow-out valves 5251 to 5256 and an auxiliary valve 5260 are checked to make sure that they are opened. Then, a main valve 5118 is opened to evacuate the insides of the film forming furnace 5110 and a gas feed pipe 5116.

Thereafter, when a vacuum gauge 5119 has been read to indicate a pressure of about 0.1 Pa, the auxiliary valve 5260 and the flow-out valves 5251 to 5256 are closed. Thereafter, valves 5231 to 5236 are opened so that gases are respectively introduced from the gas cylinders 5221 to 5226, and each gas is controlled to have a pressure of 0.2 MPa by operating pressure controllers 5261 to 5266.

Next, the flow-in valves 5241 to 5246 are slowly opened so that gases are respectively introduced into mass flow controllers 5211 to 5216.

After the film formation has been made ready to start as a result of the above procedure, the first layer, e.g., the photoconductive layer is first deposited on the substrate 5112.

That is, when the substrate 5112 has had the desired temperature, some necessary ones among the flow-out valves 5251 to 5256 and the auxiliary valve 5260 are slowly opened so that desired source gases are fed into the film forming furnace 5110 from the gas cylinders 5221 to 5226 through a gas feed pipe 5114. Next, the mass flow controllers 5211 to 5216 are operated so that each source gas is adjusted to flow at a desired rate, where the opening of the main valve 5118 is adjusted while watching the vacuum gauge 5119 so that the pressure inside the film forming furnace 5110 comes to be a desired pressure of from 13.3 Pa to 1,330 Pa. At the time the inner pressure has become stable, a high-frequency power source 5120 is set at a desired electric power and a high-frequency power with a frequency of, e.g., from 1 MHz to 50 MHz, e.g., 13.56 MHz is supplied to a cathode electrode 5111 through the high-frequency matching box 5115 to cause high-frequency glow discharge to take place. The source gases fed into the film forming furnace 5110 are decomposed by the discharge energy thus produced, so that the desired photoconductive layer composed primarily of silicon atoms is deposited on the cylindrical support 5112.

After the film with a desired thickness has been formed, the supply of high-frequency power is stopped, and the flow-out valves 5251 to 5256 are closed to stop gases from flowing into the film forming furnace 5110. The formation of the photoconductive layer is thus completed.

The composition and layer thickness of the photoconductive layer may be set according to conventionally known ones. Where subsequently the upper-part blocking layer is deposited, and where the lower-part blocking layer is deposited between the photoconductive layer and the substrate 5112, basically the above procedure may previously be repeated. The point is that the substrate on which layers constituting the first layer have been deposited is subjected to the process of removing the vertexes of protuberances.

The substrate on which the layers constituting the first layer have been deposited may preferably be subjected to the treatment of bringing it into contact with water, before the second layer is deposited thereon. A specific treating method may include washing with water and washing with an organic solvent. In consideration for environment in recent years, washing with water is more preferable. It will be described later how to carry out the washing with water. Washing with water prior to the deposition of the second layer is effective in improving the adherence between layers and lessening adhering dust.

Next, the substrate with the first layer formed thereon and subjected to the removal of the vertexes of protuberances and the treatment of bringing it into contact with water is returned again to the film forming furnace, where the plasma treatment and the deposition of the second layer are carried out.

Surface Polishing Apparatus According to the Invention

Figure 6:
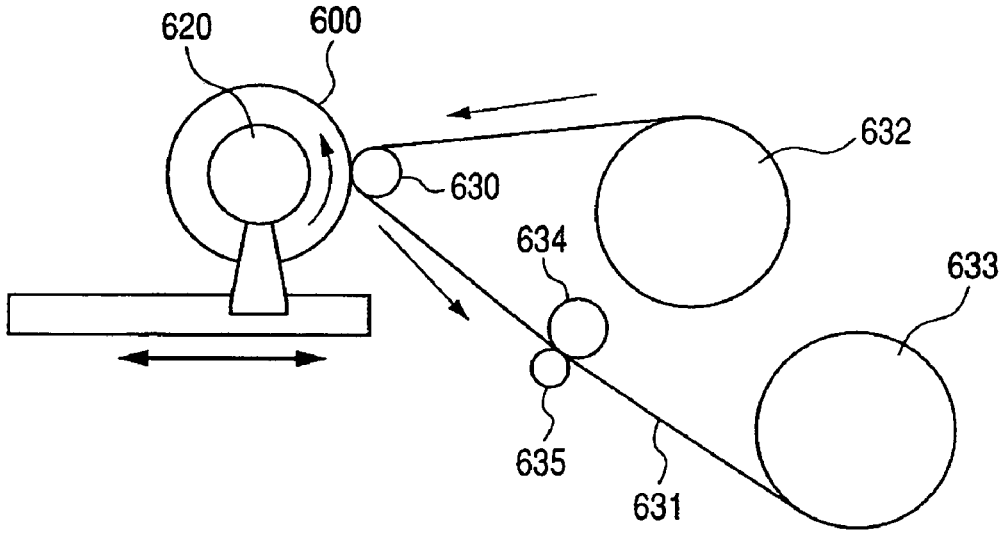
FIG. 6 is a diagrammatic sectional view of a surface polishing apparatus used in the present invention.

FIG. 6 shows an example of a surface polishing apparatus used in the production process for the negative-charging electrophotographic photosensitive member of the present invention when the process of removing the vertexes is carried out. In the example of the construction of the surface polishing apparatus as shown in FIG. 6, an object member to be processed "the surface of the deposited film on the cylindrical substrate" 600 is a cylindrical substrate the surface of which the first layer formed of a-Si has been deposited on, and is attached to an elastic support mechanism 620.

In the apparatus shown in FIG. 6, for example, an air pressure holder is used as the elastic support mechanism 620. Specifically, an air pressure holder manufactured by Bridgestone Corporation (trade name: AIR PICKER; model: PO45TCA×820) is used. A pressure elastic roller 630 is pressed against the surface of the object member to be processed 600 via a polishing tape 631 wound around the roller. The polishing tape 631 is fed from a delivery roll 632 and wound up on a wind-up roll 633. The delivery speed is regulated by a constant-rate delivery roll 634 and a capstan roller 635, and the tension is also regulated by them. As the polishing tape 631, a tape usually called a lapping tape may preferably be used. When the surface of the a-Si photoconductive layer, upper-part blocking layer or protective layer is processed, SiC, $Al_2O_3$, $Fe_2O_3$ or the like is used as abrasive grains in the lapping tape. Specifically, a lapping tape LT-C2000, available from Fuji Photo Film Co., Ltd, is used.

The roller part of the pressure elastic roller 630 is made of a material such as neoprene rubber or silicone rubber, and has a rubber hardness according to JIS standard (JIS K 6253 N method) in the range of from 20 to 80, and preferably a rubber hardness in the range of from 30 to 40. The roller part may also preferably have such a shape that, in its lengthwise direction, it has a diameter which is a little larger at the middle portion than that at both ends, preferably having, e.g., the diameter difference between the two in the range of from 0.0 to 0.6 mm, and more preferably in the range of from 0.2 to 0.4 mm. The pressure elastic roller 630 is pressed against the object member to be processed "the surface of the deposited film on the cylindrical substrate" 600 being rotated, at pressure in the range of from 0.05 MPa to 0.2 MPa, during which the lapping tape 631, e.g., the above lapping tape is fed between them to polish the deposited-film surface.

In addition, where the surface polishing is carried out in the atmosphere, a means for wet polishing such as buffing may also be used besides the above means using the polishing tape. Also, when this means for wet polishing is used, the step of removing by washing a liquid used for polishing is provided after the polishing step. In such a case, the treatment of bringing the surface into contact with water to wash the surface may also be carried out in combination.

Water Washing System According to the Invention

Figure 7:
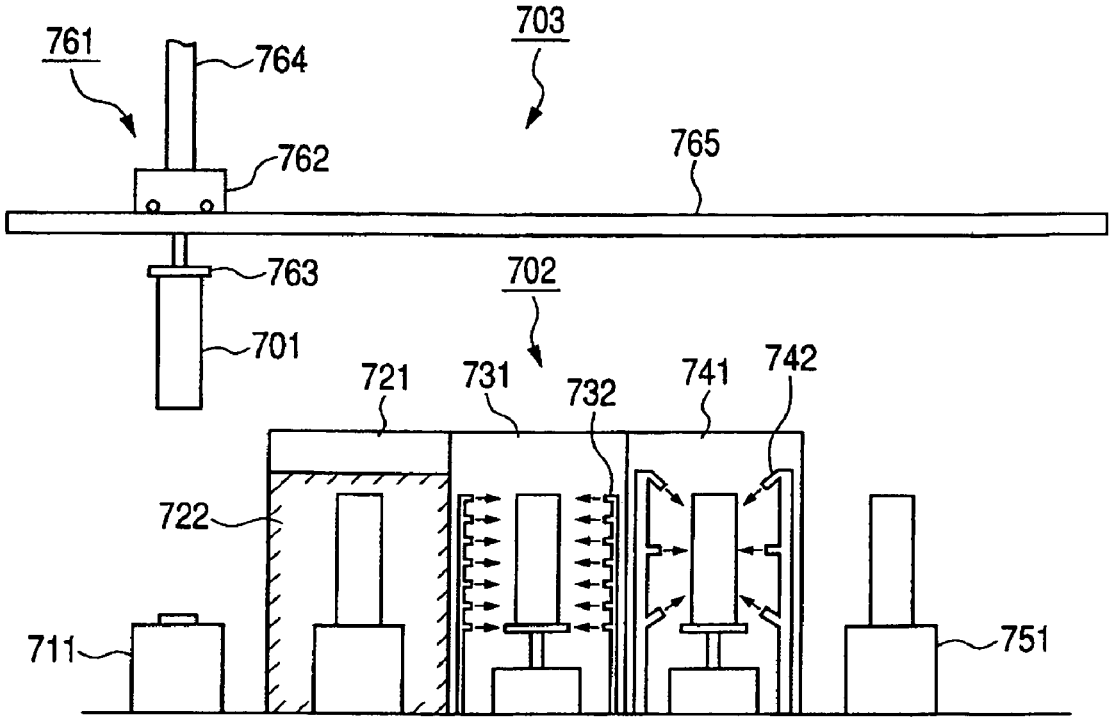
FIG. 7 is a diagrammatic sectional view of a water washing system used in the present invention.

An example of the water washing system used in the present invention is shown in FIG. 7.

The washing system shown in FIG. 7 consists of a treating section 702 and a treating object member transport mechanism 703. The treating section 702 consists of a treating object member feed stand 711, a treating object member wash chamber 721, a pure-water contact chamber 731, a drying chamber 741 and a treating object member delivery stand 751. Each of the wash chamber 721 and the purified water contact chamber 731 is fitted with a temperature control unit (not shown) for keeping the liquid temperature constant. The transport mechanism 703 consists of a transport rail 765 and a transport arm 761, and the transport arm 761 consists of a moving mechanism 762 which moves on the rail 765, a chucking mechanism 763 which holds a treating object member 701, and an air cylinder 764 for moving up and down the chucking mechanism 763. The treating object member 701 placed on the feed stand 711 is transported to the wash chamber 721 by means of the transport mechanism 703. Any oil and powder adhering to the surface are washed away by ultrasonic treatment conducted in a wash liquid 722 composed of an aqueous surface-active agent solution in the wash chamber 721. Next, the treating object member 701 is carried to the purified water contact chamber 731 by means of the transport mechanism 703, where purified water with a resistivity of 175 Ωm (17.5 MΩcm), kept at a temperature of 25° C., is sprayed against it from a nozzle 732 at a pressure of 4.9 MPa. The treating object member 701 which has been subjected to the purified water contact step is moved to the drying chamber 741 by means of the transport mechanism 703, where high-temperature high-pressure air is blown against it from a nozzle 742, so that the treating object member is dried. The treating object member 701 which has been subjected to the drying step is carried to the delivery stand 751 by means of the transport mechanism 703.

Electrophotographic Apparatus According to the Invention

Figure 8:
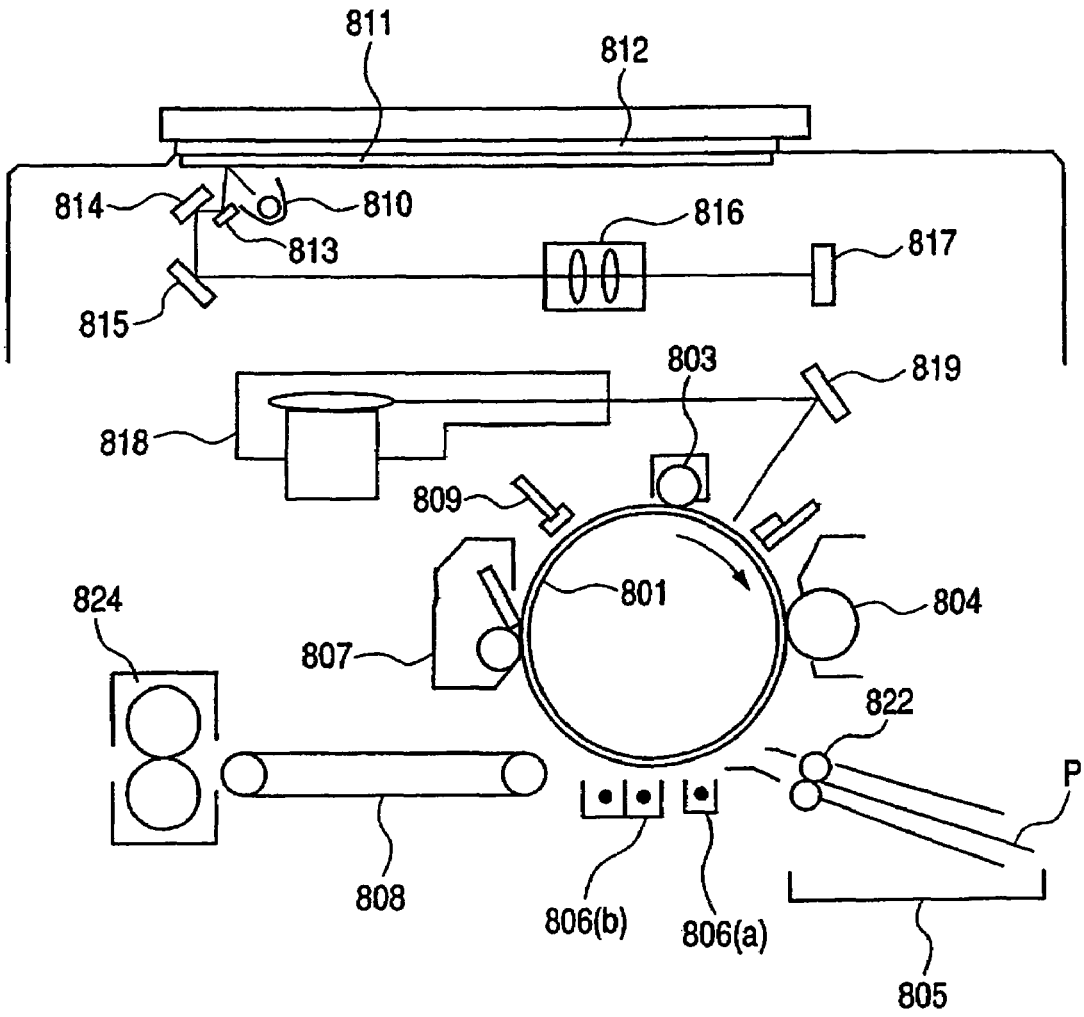
FIG. 8 is a diagrammatic sectional view showing an example of the electrophotographic apparatus of the present invention.

An example of an electrophotographic apparatus making use of the negative-charging electrophotographic photosensitive member of the present invention is shown in FIG. 8.

FIG. 8 is a diagrammatic sectional view showing an example of an image forming process of the electrophotographic apparatus. A photosensitive member 801 is rotated to perform copying operation. The photosensitive member 801 is provided around it with a magnetic-brush injection charging assembly 803, a developing assembly 804, a transfer sheet feed system 805, a transfer charging assembly 806(*a*), a separation charging assembly 806(*b*), a cleaning unit 807, a transport system 808, a de-charging light source 809 and so forth.

To more specifically describe the image forming process below, the photosensitive member 801 is uniformly charged by the magnetic-brush injection charging assembly 803. Next, an electrostatic latent image is formed by the light emitted from a laser unit 818 and going through a mirror 819. A negatively chargeable toner is fed to this latent image from the developing assembly 804, and a toner image is formed. To control the laser unit 818, signals from a CCD unit 817 are used. More specifically, the light emitted from a lamp 810 is reflected by an original 812 placed on an original glass plate 811 and goes through mirrors 813, 814 and 815, and an image is formed by lenses of a lens unit 816. This image is converted into electrical signals by the CCD unit 817, and the signals are used.

Meanwhile, a transfer material P is fed through the transfer sheet feed system 805 toward the photosensitive member 801 while timing is adjusted by registration rollers 822, and is provided from its backside with a positive electric field having polarity opposite to that of toner at the gap between the transfer charging assembly 806(*a*) to which a high voltage is applied and the photosensitive member 801. As a result, toner images with a negative polarity which are held on the photosensitive member surface are transferred to the transfer material P. Subsequently, the transfer material P is separated from the photosensitive member surface by the separation charging assembly 806(*b*), then transported by the transport system 808 to reach a fixing assembly 824, where the toner images are fixed, and then discharged out of the apparatus.

EXAMPLES

The present invention is described below in greater detail by giving Examples and Comparative Examples. Incidentally, the present invention is by no means limited to these Examples.

Example 1

Using the a-Si photosensitive member film forming apparatus shown in FIG. 5, which is of an RF plasma-assisted CVD system, a lower-part blocking layer formed of at least a non-single-crystal material and a photoconductive layer formed of at least a non-single-crystal material were deposited as the first layer on an aluminum substrate of 80 mm in outer diameter under conditions shown in Table 1. Thereafter, the substrate with the first layer deposited thereon was taken out of the film forming furnace to expose it to the atmosphere, and thereafter subjected to polishing to remove protuberances at least at their vertexes on the first layer surface, and then to the treatment of bringing the first layer surface into contact with water. Thereafter, the substrate with the first layer deposited thereon, which had been processes in this way, was placed in the film forming furnace, and, before the second layer was deposited, subjected to plasma treatment in which, as to the boron content (the content of boron atoms in the flow of all gases fed) shown in Table 2, the flow rate of $B_2H_6$ gas (2,850 ppm/$H_2$) was changed as shown in Table 3, and then the second layer was deposited under conditions shown in Table 1. Thus, negative-charging electrophotographic photosensitive members were produced. Chargeability of the negative-charging electrophotographic photosensitive members thus produced was evaluated in the following way. Results obtained are shown in Table 3. As shown in the table, Examples 1—1 to 1–8 were allotted to the boron content of $1.0\times10^{-4}$ to $3.0\times10^{-2}$ (mol %).

The peak value of the content distribution of boron in the interfacial region between the first layer and the second layer of each of the photosensitive members produced was analyzed by SIMS (secondary-ion mass spectroscopy). Here, the peak value in the interfacial region is obtained, and hence it indicates an absolute value, not the proportion of the boron to other constituent elements. Results obtained are also shown together in Table 3.

Chargeability

The electrophotographic photosensitive members produced were each set in the electrophotographic apparatus and charged, and the dark-area surface potential of each electrophotographic photosensitive member was measured with a surface potentiometer set at the position of the developing assembly to examine their chargeability. Here, for comparison, charging conditions (DC voltage applied to the charging assembly, superimposed-AC amplitude, frequency and so forth) were set constant. Results obtained were ranked by relative evaluation where the value in Example 1—1 was regarded as a standard (100%).

A: 105% or more.

B: Less than 105%.

TABLE 1

| | First layer | | Second |
|---|---|---|---|
| | Lower = part blocking layer | Photoconductive layer | layer Surface protective layer |
| Source gases and flow rates: | | | |
| $SiH_4$ [ml/min(normal)] | 100 | 100 | 10 |
| $H_2$ [ml/min(normal)] | 600 | 800 | — |
| NO [ml/min(normal)] | 8 | — | — |
| $CH_4$ [ml/min(normal)] | — | — | 600 |
| Substrate temperature (° C.): | 260 | 260 | 180 |
| Reactor internal pressure (Pa): | 64 | 79 | 60 |
| High-frequency power (W): | 100 | 400 | 180 |
| Layer thickness (μm): | 3 | 20 | 0.8 |

TABLE 2

| Source gases and flow rates | Plasma treatment |
|---|---|
| $H_2$ [ml/min(normal)] | 796 |
| B (mol %) | changed |
| [$B_2H_6$ (ppm) (based on $H_2$)] | |
| Substrate temperature (° C.) | 180 |
| Reactor internal pressure (Pa) | 87 |
| High-frequency power (W) | 400 |

TABLE 3

| | Example 1 | | | |
|---|---|---|---|---|
| | 1-1 | 1-2 | 1-3 | 1-4 |
| B content: (mol %) | $1.0 \times 10^{-4}$ | $2.0 \times 10^{-4}$ | $1.0 \times 10^{-3}$ | $5.0 \times 10^{-3}$ |
| B peak value: (atoms/cm$^3$) | $3.0 \times 10^{17}$ | $5.0 \times 10^{17}$ | $1.0 \times 10^{19}$ | $2.1 \times 10^{20}$ |
| Chargeability: | B | A | A | A |
| | Example | | | |
| | 1-5 | 1-6 | 1-7 | 1-8 |
| B content: (mol %) | $8.0 \times 10^{-3}$ | $1.0 \times 10^{-2}$ | $2.0 \times x10^{-2}$ | $3.0 \times 10^{-2}$ |
| B peak value: (atoms/cm$^3$) | $3.0 \times 10^{20}$ | $4.2 \times 10^{20}$ | $1.0 \times 10^{21}$ | $2.5 \times 10^{21}$ |
| Chargeability: | A | A | A | B |

From the results shown in Table 3, it has turned out that, as to the boron content (the content of boron atoms in the flow of all gases fed) at the time of the plasma treatment carried out before the second layer is deposited, the range of from $2.0\times10^{-4}$ mol % or more to $2.0\times10^{-2}$ or less in Example 1–2 to Example 1–7 is the optimum range. It has also turned out that, as to the peak value of the content distribution of boron in the interfacial region between the first layer and the second layer, the range of from $5.0\times10^{17}$ atoms/cm$^3$ or more to $1.0\times10^{21}$ atoms/cm$^3$ or less in Example 1–2 to Example 1–7 is the optimum range.

Example 2

According to the procedure of Example 1, which was changed only in that the treatment of bringing the first layer surface into contact with water was not carried out, a negative-charging electrophotographic photosensitive member was produced under conditions shown in Table 5. In respect of costs, the adherence between layers, polishing mars, chargeability, image defects and potential non-uniformity, evaluation was made in the manner as described below. Results obtained are shown in Table 18.

Example 3

According to the procedure of Example 1, which was changed only in that in the first layer, the upper-part blocking layer formed of at least a non-single-crystal material was additionally deposited, a negative-charging electrophotographic photosensitive member was produced under conditions shown in Table 6. In respect of costs, the adherence between layers, polishing mars, chargeability, image defects and potential non-uniformity, evaluation was made in the manner as described below. Results obtained are shown in Table 18.

Example 4

According to the procedure of Example 3, which was changed only in that in the first layer, the protective layer formed of at least a non-single-crystal material was additionally deposited, a negative-charging electrophotographic photosensitive member was produced under conditions shown in Table 7. In respect of costs, the adherence between layers, polishing mars, chargeability, image defects and potential non-uniformity, evaluation was made in the manner as described below. Results obtained are shown in Table 18.

Example 5

According to the procedure of Example 4, which was changed in that in the first layer, the flow rate of $B_2H_6$ of the upper-part blocking layer to be deposited was changed as shown in Table 4 to change the content of the Group 13 element (boron) of the periodic table based on the total number of constituent elements contained in the upper-part blocking layer, photosensitive members 5-1 to 5-6 were produced under conditions shown in Table 8. In respect of costs, the adherence between layers, polishing mars, chargeability, image defects and potential non-uniformity, evaluation was made in the manner as described below. Results obtained are shown in Table 18.

In addition, the content of the Group 13 element (boron) of the periodic table based on the total number of constituent elements in the photosensitive members 5-1 to 5-6 each was analyzed by SIMS (secondary-ion mass spectroscopy). Results obtained are shown in Table 4.

TABLE 4

| | Example 5 | | | | | |
|---|---|---|---|---|---|---|
| | 5-1 | 5-2 | 5-3 | 5-4 | 5-5 | 5-6 |
| $B_2H_6$ flow rate: (ppm) (based on $SiH_4$) | 90 | 115 | 1,075 | 10,700 | 32,000 | 37,400 |
| B content in upper-part blocking layer: (ppm) | 80 | 100 | 1,000 | 10,000 | 30,000 | 35,000 |

Example 6

According to the procedure of Example 4, which was changed only in that as the second layer, a non-single-crystal material layer composed primarily of carbon atoms [a-C(H) layer] was deposited, a negative-charging electrophotographic photosensitive member was produced under conditions shown in Table 9. In respect of costs, the adherence between layers, polishing mars, chargeability, image defects and potential non-uniformity, evaluation was made in the manner as described below. Results obtained are shown in Table 18.

Examples 7 to 11

According to the procedure of Example 4, which was changed only in that in the first layer, the upper-part blocking layer was deposited changing the compositional ratio of carbon to silicon which constitute the layer in the layer thickness direction as shown in FIG. 10, negative-charging electrophotographic photosensitive members of Examples 7 to 11 were produced under conditions shown in Tables 10 to 14, respectively. In respect of costs, the adherence between layers, polishing mars, chargeability, image defects and potential non-uniformity, evaluation was made in the manner as described below. Results obtained are shown in Table 18.

Comparative Example 1

According to the procedure of Example 1, which was changed only in that the plasma treatment carried out before the second layer was deposited was carried out under conditions shown in Table 15, a negative-charging electrophotographic photosensitive member was produced under conditions also shown in Table 15. In respect of costs, the adherence between layers, polishing mars, chargeability, image defects and potential non-uniformity, evaluation was made in the manner as described below. Results obtained are shown in Table 18.

Comparative Example 2

According to the procedure of Example 4, which was changed in that the plasma treatment of the surface of the first layer deposited on the substrate was not carried out and in that an upper-part blocking layer and a surface protective layer which were each formed of a non-single-crystal material were deposited as the second layer, a negative-charging electrophotographic photosensitive member was produced under conditions shown in Table 16. In respect of costs, the adherence between layers, polishing mars, chargeability, image defects and potential non-uniformity, evaluation was made in the manner as described below. Results obtained are shown in Table 18.

Comparative Example 3

According to the procedure of Comparative Example 2, which was changed only in that in the second layer, an intermediate layer formed of at least a non-single-crystal material was additionally deposited, a negative-charging electrophotographic photosensitive member was produced under conditions shown in Table 17. In respect of costs, the adherence between layers, polishing mars, chargeability, image defects and potential non-uniformity, evaluation was made in the manner as described below. Results obtained are shown in Table 18.

As to the negative-charging electrophotographic photosensitive member produced in Example 1, too, evaluation was made in respect of costs, the adherence between layers, polishing mars, chargeability, image defects and potential non-uniformity in the manner as described below. Results obtained are also shown together in Table 18.

Costs

Evaluation was relatively made regarding Comparative Example 3 as a standard. "A" indicates that the cost was reduced by 15% or more, as compared with that in Comparative Example 3; "B", the cost was reduced by 10% or more to less than 15%, as compared with that in Comparative Example 3; "C", the cost was reduced by 5% or more to less than 10%, compared with that in Comparative Example 3; "D", the cost was reduced by 1% or more to less than 5%, compared with that in Comparative Example 3; and "E", the cost was equal to that in Comparative Example 3.

Adherence Between Layers

The adherence between the first layer and the second layer was measured with HEIDON (Type: 14 S), manufactured by Shinto Kagaku Kogyo K. K. Using this instrument, the surface of each photosensitive member in which the respective layers were superposed was scratched with a diamond needle, and the adherence between the layers was evaluated according to the measure of the load applied to the diamond needle when peeling occurs on the photosensitive member surface. Results obtained were ranked by relative evaluation where the value in Comparative Example 3 was regarded as 100%.

A: 105% or more.

B: 95% or more to less than 105%.

C: Less than 95%.

Polishing Mars

The surface of each electrophotographic photosensitive member after the polishing was observed with an optical microscope. Then, protuberances of about 30 μm in diameter were removed by polishing up to the level line, where scratches caused by the polishing and extending from the protuberant portions to the normal portion were noted as polishing mars to examine whether or not they were seen.

Here, in judgement letter symbols in the table, "A" indicates that no polishing mar is seen at the normal portion; "B", slight polishing mars occurred in five or less lines on the whole surface of the photosensitive member; and "C", slight polishing mars occurred in five or more lines on the whole surface of the photosensitive member.

Chargeability

The electrophotographic photosensitive members produced were each set in the electrophotographic apparatus and charged, and the dark-area surface potential of each electrophotographic photosensitive member was measured with a surface potentiometer set at the position of the developing assembly to examine their chargeability. Here, for comparison, charging conditions (DC voltage applied to the charging assembly, superimposed-AC amplitude, frequency and so forth) were set to be constant. Results obtained were ranked by relative evaluation where the value in Comparative Example 3 was regarded as a standard (100%).

A: 95% or more.

B: 85% or more to less than 95%.

C: 75% or more to less than 85%.

D: Less than 75%.

Image Defects

Image defects were evaluated according to the number of black dots of 0.1 mm or less in diameter in images of 0% in pixel density. In regard to black dots with the size of more than 0.1 mm in diameter, almost all of them are caused by dust or the like having adhered to the substrate on which the film formation for the photosensitive member has not been started, where the occurrence of such image defects is hardly affected by the conditions at the time of film formation, and hence it is substantial to improve the process so that dust is reduced so as not to cause image defects. This has been found from the results of various researches conducted by the present inventors. Accordingly, such black dots were excluded from what was to be evaluated, and evaluation was made concentrating on the numerical quantity of relatively small image defects of 0.1 mm or less in diameter which were affected by the conditions at the time of film formation. Results obtained were ranked by relative evaluation where the value in Comparative Example 1 was regarded as a standard (100%).

A: Less than 90%.

B: 90% or more.

Potential Non-Uniformity

Using iR 6000 (process speed: 265 mm/sec), manufactured by CANON INC., its primary charging assembly was remodeled into one for magnetic-brush charging. The charging assembly was so adjusted as to give a dark-area potential of −450 V at the position of the developing assembly and the light amount of an exposure light source was so adjusted as to give a light-area potential of −100 V at the position of the developing assembly, and in such a state, the in-plane distribution of the difference between the dark-area potential and the light-area potential was measured. The difference between the maximum value and the minimum value in that difference was regarded as potential non-uniformity. Results obtained were ranked by relative evaluation where the value in Comparative Example 1 was regarded as a standard (100%).

A: Less than 90%.

B: 90% or more.

Overall Evaluation

The evaluation results made on costs, the adherence between layers and polishing mars were overall ranked in the following way, on the basis of points found by adding up 3 points for rank A, 2 points for rank B, 1 point for rank C and 0 point for ranks D and E.

S: 16 points or more, having 5 or more of rank A and no ranks D and E (very much excellent).

A: 15 points or more, having 4 or more of rank A and no ranks D and E (very excellent).

B: 14 points or more, having 1 or less of rank C and no ranks D and E (excellent).

C: 12 points or more, having 2 or less of rank C and no ranks D and E (good).

D: Less than 12 points, or having at least 1 of rank D or E (no problem in practical use)

TABLE 5

| | First layer | | | Second layer |
|---|---|---|---|---|
| | Lower-part blocking layer | Photoconductive layer | Plasma treatment | Surface protective layer |
| Source gases and flow rates: | | | | |
| $SiH_4$ [ml/min(normal)] | 100 | 100 | — | 10 |
| $H_2$ [ml/min(normal)] | 600 | 600 | 796 | — |
| $B_2H_6$ (ppm) (based on $SiH_4$) | — | — | — | — |
| B (mol %) [$B_2H_6$ (ppm) (based on $H_2$)] | — | — | $2.98 \times 10^{-3}$ [15] | — |
| NO [ml/min(normal)] | 8 | — | — | — |
| $CH_4$ [ml/min(normal)] | — | — | — | 550 |
| Substrate temperature: (° C.) | 260 | 260 | 180 | 180 |
| Reactor internal pressure: (Pa) | 64 | 79 | 87 | 60 |
| High-frequency power: (W) | 100 | 350 | 400 | 180 |
| Layer thickness: (μm) | 3 | 20 | — | 0.8 |

TABLE 6

| | First layer | | | | Second layer |
|---|---|---|---|---|---|
| | Lower = part blocking layer | Photo-conductive layer | Upper = part blocking layer | Plasma treatment | Surface protective layer |
| Source gases and flow rates: | | | | | |
| $SiH_4$ [ml/min(normal)] | 100 | 100 | 90 | — | 10 |
| $H_2$ [ml/min(normal)] | 600 | 800 | — | 784 | — |
| $B_2H_6$ (ppm) (based on $SiH_4$) | — | — | 300 | — | — |
| B (mol %) [$B_2H_6$ (ppm) (based on $H_2$)] | — | — | — | $1.18 \times 10^{-2}$ [60] | — |
| NO [ml/min(normal)] | 8 | — | — | — | — |
| $CH_4$ [ml/min(normal)] | — | — | 90 | — | 600 |
| Substrate temperature: (° C.) | 260 | 260 | 260 | 180 | 180 |
| Reactor internal pressure: (Pa) | 64 | 79 | 60 | 87 | 60 |
| High-frequency power: (W) | 100 | 400 | 300 | 400 | 180 |
| Layer thickness: (μm) | 3 | 20 | 0.2 | — | 0.8 |

TABLE 7

| | First layer | | | | | Second layer |
|---|---|---|---|---|---|---|
| | Lower = part blocking layer | Photo-conductive layer | Upper = part blocking layer | Protective layer | Plasma treatment | Surface protective layer |
| Source gases and flow rates: | | | | | | |
| $SiH_4$ [ml/min(normal)] | 100 | 100 | 200 | 10 | — | 10 |
| $H_2$ [ml/min(normal)] | 600 | 800 | — | — | 778 | — |
| $B_2H_6$ (ppm) (based on $SiH_4$) | — | — | 900 | — | — | — |
| B (mol %) [$B_2H_6$ (ppm) (based on $H_2$)] | — | — | — | — | $1.56 \times 10^{-2}$ [80] | — |
| NO [ml/min(normal)] | 8 | — | — | — | — | — |
| $CH_4$ [ml/min(normal)] | — | — | 150 | 600 | — | 500 |
| Substrate temperature: (° C.) | 260 | 260 | 260 | 260 | 180 | 180 |
| Reactor internal pressure: (Pa) | 64 | 79 | 60 | 60 | 87 | 60 |
| High-frequency power: (W) | 100 | 400 | 300 | 180 | 400 | 180 |
| Layer thickness: (μm) | 3 | 20 | 0.2 | 0.5 | — | 0.8 |

TABLE 8

| | First layer | | | | | Second layer |
|---|---|---|---|---|---|---|
| | Lower = part blocking layer | Photo-conductive layer | Upper = part blocking layer | Protective layer | Plasma treatment | Surface protective layer |
| Source gases and flow rates: | | | | | | |
| $SiH_4$ [ml/min(normal)] | 100 | 100 | 90 | 10 | — | 30 |
| $H_2$ [ml/min(normal)] | 600 | 800 | — | — | 789 | — |
| $B_2H_6$ (ppm) (based on $SiH_4$) | — | — | changed | — | — | — |
| B (mol %) [$B_2H_6$ (ppm) (based on $H_2$)] | — | — | — | — | $7.89 \times 10^{-3}$ [40] | — |
| NO [ml/min(normal)] | 8 | — | — | — | — | — |
| $CH_4$ [ml/min(normal)] | — | — | 90 | 600 | — | 600 |
| Substrate temperature: (° C.) | 260 | 260 | 260 | 260 | 180 | 180 |
| Reactor internal pressure: (Pa) | 64 | 79 | 60 | 60 | 87 | 60 |
| High-frequency power: (W) | 100 | 400 | 300 | 180 | 400 | 180 |
| Layer thickness: (μm) | 3 | 20 | 0.2 | 0.5 | — | 0.8 |

TABLE 9

| | First layer | | | | | Second layer |
|---|---|---|---|---|---|---|
| | Lower = part blocking layer | Photo-conductive layer | Upper = part blocking layer | Protective layer | Plasma treatment | Surface protective layer |
| Source gases and flow rates: | | | | | | |
| $SiH_4$ [ml/min(normal)] | 100 | 100 | 100 | 10 | — | — |
| $H_2$ [ml/min(normal)] | 600 | 800 | — | — | 797 | — |
| $B_2H_6$ (ppm) (based on $SiH_4$) | — | — | 800 | — | — | — |
| B (mol %) [$B_2H_6$ (ppm) (based on $H_2$)] | — | — | — | — | $2.0 \times 10^{-3}$ [10] | — |
| NO [ml/min(normal)] | 8 | — | — | — | — | — |
| $CH_4$ [ml/min(normal)] | — | — | 150 | 600 | — | 55 |

TABLE 9-continued

| | First layer | | | | | Second layer |
|---|---|---|---|---|---|---|
| | Lower = part blocking layer | Photo-conductive layer | Upper = part blocking layer | Protective layer | Plasma treatment | Surface protective layer |
| Substrate temperature: (° C.) | 260 | 260 | 260 | 260 | 180 | room temp. |
| Reactor internal pressure: (Pa) | 64 | 79 | 60 | 60 | 87 | 67 |
| High-frequency power: (W) | 100 | 400 | 300 | 180 | 400 | 550 |
| Layer thickness: (μm) | 3 | 20 | 0.2 | 0.5 | — | 0.6 |

TABLE 10

| | Upper-part blocking layer | | |
|---|---|---|---|
| Source gases and flow rates: | | | |
| $SiH_4$ [ml/min(normal)] | 100 > 10 | 10 > 10 | 10 > 10 |
| $H_2$ [ml/min(normal)] | — | — | — |
| $B_2H_6$ (ppm) (based on $SiH_4$) | — | 0 > 400 > 0 | — |
| B (mol %) [$B_2H_6$ (ppm) (based on $H_2$)] | — | — | — |
| NO [ml/min(normal)] | — | — | — |
| $CH_4$ [ml/min(normal)] | 0 > 800 | 800 > 700 | 700 > 600 |
| Substrate temperature: (° C.) | 260 | 260 | 260 |
| Reactor internal pressure: (Pa) | 60 | 60 | 60 |
| High-frequency power: (W) | 300 | 300 | 300 |
| Layer thickness: (μm) | 0.1 | 0.08 | 0.1 |

TABLE 11

| | Upper-part blocking layer | | |
|---|---|---|---|
| Source gases and flow rates: | | | |
| $SiH_4$ [ml/min(normal)] | 100 > 10 | 10 > 10 | 10 > 10 |
| $H_2$ [ml/min(normal)] | — | — | — |
| $B_2H_6$ (ppm) (based on $SiH_4$) | — | 0 > 400 > 0 | — |
| B (mol %) [$B_2H_6$ (ppm) (based on $H_2$)] | — | — | — |
| NO [ml/min(normal)] | — | — | — |
| $CH_4$ [ml/min(normal)] | 0 > 400 | 400 > 550 | 550 > 600 |
| Substrate temperature: (° C.) | 260 | 260 | 260 |
| Reactor internal pressure: (Pa) | 60 | 60 | 60 |
| High-frequency power: (W) | 300 | 300 | 300 |
| Layer thickness: (μm) | 0.1 | 0.08 | 0.1 |

TABLE 12

| | Upper-part blocking layer | | |
|---|---|---|---|
| Source gases and flow rates: | | | |
| $SiH_4$ [ml/min(normal)] | 100 > 25 | 25 > 15 | 15 > 10 |
| $H_2$ [ml/min(normal)] | — | — | — |

TABLE 12-continued

| | Upper-part blocking layer | | |
|---|---|---|---|
| $B_2H_6$ (ppm) (based on $SiH_4$) | — | 0 > 400 > 0 | — |
| B (mol %) [$B_2H_6$ (ppm) (based on $H_2$)] | — | — | — |
| NO [ml/min(normal)] | — | — | — |
| $CH_4$ [ml/min(normal)] | 0 > 400 | 400 > 500 | 500 > 600 |
| Substrate temperature: (° C.) | 260 | 260 | 260 |
| Reactor internal pressure: (Pa) | 60 | 60 | 60 |
| High-frequency power: (W) | 300 | 300 | 300 |
| Layer thickness: (μm) | 0.1 | 0.08 | 0.1 |

TABLE 13

| | Upper-part blocking layer | | |
|---|---|---|---|
| Source gases and flow rates: | | | |
| $SiH_4$ [ml/min(normal)] | 100 > 80 | 80 > 60 | 60 > 10 |
| $H_2$ [ml/min(normal)] | — | — | — |
| $B_2H_6$ (ppm) (based on $SiH_4$) | — | 0 > 400 > 0 | — |
| B (mol %) [$B_2H_6$ (ppm) (based on $H_2$)] | — | — | — |
| NO [ml/min(normal)] | — | — | — |
| $CH_4$ [ml/min(normal)] | 0 > 200 | 200 > 500 | 500 > 600 |
| Substrate temperature: (° C.) | 260 | 260 | 260 |
| Reactor internal pressure: (Pa) | 60 | 60 | 60 |
| High-frequency power: (W) | 300 | 300 | 300 |
| Layer thickness: (μm) | 0.1 | 0.08 | 0.1 |

TABLE 14

| | Upper-part blocking layer | | |
|---|---|---|---|
| Source gases and flow rates: | | | |
| $SiH_4$ [ml/min(normal)] | 100 > 30 | 30 > 60 | 60 > 10 |
| $H_2$ [ml/min(normal)] | — | — | — |
| $B_2H_6$ (ppm) (based on $SiH_4$) | — | 0 > 400 > 0 | — |
| B (mol %) [$B_2H_6$ (ppm) (based on $H_2$)] | — | — | — |
| NO [ml/min(normal)] | — | — | — |

TABLE 14-continued

| | Upper-part blocking layer | | |
|---|---|---|---|
| $CH_4$ [ml/min(normal)] | 0 > 400 | 400 > 500 | 500 > 600 |
| Substrate temperature: (° C.) | 260 | 260 | 260 |
| Reactor internal pressure: (Pa) | 60 | 60 | 60 |
| High-frequency power: (W) | 300 | 300 | 300 |
| Layer thickness: (μm) | 0.1 | 0.08 | 0.1 |

TABLE 15

| | First layer | | | Second layer |
|---|---|---|---|---|
| | Lower-part blocking layer | Photoconductive layer | Plasma treatment | Surface protective layer |
| Source gases and flow rates: | | | | |
| $SiH_4$ [ml/min(normal)] | 100 | 100 | — | 10 |
| $H_2$ [ml/min(normal)] | 600 | 600 | 800 | — |
| $B_2H_6$ (ppm) (based on $SiH_4$) | — | — | — | — |
| NO [ml/min(normal)] | 8 | — | — | — |
| $CH_4$ [ml/min(normal)] | — | — | — | 550 |
| Substrate temperature: (° C.) | 260 | 260 | 180 | 180 |
| Reactor internal pressure: (Pa) | 64 | 79 | 87 | 60 |
| High-frequency power: (W) | 100 | 350 | 400 | 180 |
| Layer thickness: (μm) | 3 | 20 | — | 0.8 |

TABLE 16

| | First layer | | | | Second layer | |
|---|---|---|---|---|---|---|
| | Lower = part blocking layer | Photo-conductive layer | Upper = part blocking layer | Protective layer | Upper-part blocking layer | Surface protective layer |
| Source gases and flow rates: | | | | | | |
| $SiH_4$ [ml/min(normal)] | 100 | 100 | 90 | 10 | 90 | 50 |
| $H_2$ [ml/min(normal)] | 600 | 800 | — | — | — | — |
| $B_2H_6$ (ppm) (based on $SiH_4$) | — | — | 300 | — | 300 | — |
| NO [ml/min(normal)] | 8 | — | — | — | — | — |
| $CH_4$ [ml/min(normal)] | — | — | 90 | 600 | 90 | 600 |
| Substrate temperature: (° C.) | 260 | 260 | 260 | 260 | 180 | 180 |
| Reactor internal pressure: (Pa) | 64 | 79 | 60 | 60 | 60 | 60 |
| High-frequency power: (W) | 100 | 400 | 300 | 180 | 300 | 180 |
| Layer thickness: (μm) | 3 | 20 | 0.2 | 0.5 | 0.2 | 0.8 |

TABLE 17

| | First layer | | | | Second layer | | |
|---|---|---|---|---|---|---|---|
| | Lower = part blocking layer | Photo-conductive layer | Upper = part blocking layer | Protective layer | Intermediate layer | Upper = part blocking layer | Surface protective layer |
| Source gases and flow rates: | | | | | | | |
| $SiH_4$ [ml/min(normal)] | 100 | 100 | 90 | 10 | 10 | 90 | 10 |
| $H_2$ [ml/min(normal)] | 600 | 800 | — | — | — | — | — |
| $B_2H_6$ (ppm) (based on $SiH_4$) | — | — | 300 | — | — | 300 | — |

TABLE 17-continued

| | First layer | | | | Second layer | | |
|---|---|---|---|---|---|---|---|
| | Lower = part blocking layer | Photo-conductive layer | Upper = part blocking layer | Protective layer | Intermediate layer | Upper = part blocking layer | Surface protective layer |
| NO [ml/min(normal)] | 8 | — | — | — | — | — | — |
| $CH_4$ [ml/min(normal)] | — | — | 90 | 600 | 600 | 90 | 600 |
| Substrate temperature: (° C.) | 260 | 260 | 260 | 260 | 180 | 180 | 180 |
| Reactor internal pressure: (Pa) | 64 | 79 | 60 | 60 | 60 | 60 | 60 |
| High-frequency power: (W) | 100 | 400 | 300 | 180 | 180 | 300 | 180 |
| Layer thickness: (μm) | 3 | 20 | 0.2 | 0.5 | 0.2 | 0.2 | 0.8 |

TABLE 18

| | conditions $B_2H_6$-added | Evaluation items | | | | | | |
|---|---|---|---|---|---|---|---|---|
| | plasma treatment | Cost | Adherence | Polishing mars | Chargeability | Image defects | Potential non-uniformity | Overall eval. |
| Example: | | | | | | | | |
| 1-1, 1-8 | Yes | A | A | C | C | A | B | C |
| 1-2 to 1-7 | Yes | A | A | C | B | A | B | B |
| 2 | Yes | A | B | C | C | A | B | C |
| 3 | Yes | B | A | B | A | A | B | B |
| 4 | Yes | C | A | A | A | A | B | A |
| 5-1, 5-6 | Yes | C | A | A | B | A | B | B |
| 5-2 to 5-5 | Yes | C | A | A | A | A | B | A |
| 6 | Yes | C | A | A | A | A | B | A |
| 7 | Yes | C | A | A | A | A | B | A |
| 8 to 10 | Yes | C | A | A | A | A | A | S |
| 11 | Yes | C | A | A | A | A | B | A |
| Comparative Example: | | | | | | | | |
| 1 | No | A | A | C | D | B | B | D |
| 2 | No | D | C | A | A | A | B | D |
| 3 | No | E | B | A | A | A | B | D |

As can be seen from Table 18, Comparative Examples 2 and 3 employ a method in which the plasma treatment is not carried out before the second layer is deposited and the upper-part blocking layer is deposited as the second layer, therefore resulting in the low adherence between layers insufficient for photosensitive members. It is necessary to deposite the upper-part blocking layer as the second layer or to deposit the intermediate layer in order to increase the adherence between layers to a certain extent. As a result, a total rise in cost occurred.

On the other hand, in Examples 1 to 11, the surface of the first layer is plasma-treated before the second layer is deposited, whereby the surfaces of protuberances having been subjected to the process of removing the vertexes of protuberances were modified in the order of several atoms as a result of the plasma treatment to be endowed with the ability to block the acquired electric charges, and hence the acquired electric charges can be prevented from entering the protuberances. Thus, the effect of lessening image defects can be maintained without depositing any upper-part blocking layer as the second layer. According to such a feature that any upper-part blocking layer is no longer required to be deposited as the second layer, the total costs can be reduced and the improvement of the adherence between layers can be realized without lowering the effect of lessening image defects, as compared with the Comparative Examples.

It has also turned out from the results obtained in Example 5 that the Group 13 element (boron) in the periodic table may be in a content of from 100 atomic ppm or more to 30,000 atomic ppm or less based on the total number of constituent elements, which is preferable in view of chargeability. It has still also turned out from the results obtained in Examples 7 to 11 that the upper-part blocking layer may be so formed that the compositional ratio of carbon to silicon which constitute that layer increases toward the surface side, thereby remedying potential non-uniformity.

In addition, it has been ascertained from the results obtained in Examples 1 and 2 that the treatment of bringing the surface of the first layer into contact with water improves the adherence between layers and chargeability.

Next, the negative-charging electrophotographic photosensitive members produced in Examples 4 and 9 and Comparative Example 1 were evaluated only on potential non-uniformity in the following way. Results obtained are shown in Table 19.

Potential Non-Uniformity

The iR 6000 (process speed: 265 mm/sec), manufactured by CANON INC., was used in which a corona charging assembly was used as a primary charging assembly. The charging assembly was so adjusted as to give a dark-area potential of −450 V at the position of the developing assembly and the light amount of an exposure light source was so adjusted as to give a light-area potential of −100 V at the position of the developing assembly, and in such a state, the in-plane distribution of the difference between the dark-area potential and the light-area potential was measured. Results obtained were ranked by relative evaluation where the value in Comparative Example 1 was regarded as a standard (100%) (In Comparative Example 1, the iR 6000 (process speed: 265 mm/sec), manufactured by CANON INC., the primary charging assembly of which was remodeled into one for magnetic-brush charging, was used).

A: Less than 90%.

B: 90% or more to less than 110%.

C: 110% or more.

TABLE 19

| | Photosensitive member produced in: | | |
|---|---|---|---|
| | Example | | Comparative Example |
| | 4 | 9 | 1 |
| Potential non-uniformity: | C | B | C |

As can be seen from Tables 18 and 19, it has been ascertained that the use of the magnetic-brush charging assembly improves the control of potential non-uniformity.

The same effect as in Examples was obtained also when argon or helium was used as the dilution gas at the time of the plasma treatment carried out before the second layer was deposited.

This application claims priorities from Japanese Patent Application No. 2004-239490 filed on Aug. 19, 2004 and Japanese Patent Application No. 2005-227750 filed on Aug. 5, 2005, the contents of which are incorporated hereinto by reference.

What is claimed is:

1. A process for producing a negative charging electrophotographic photosensitive member having a layer formed of a non-single-crystal material; the process comprising the steps of:

as a first step, the sub-steps comprising (a) placing a cylindrical substrate having a conductive surface in a film forming furnace connected to an evacuation means, having a source gas feed means and capable of being made vacuum-airtight, and decomposing a source gas by high frequency power to deposit on the substrate a photoconductive layer formed of at least a non-single-crystal material as a first layer and (b) forming on the surface side of said photoconductive layer in said first layer an upper-part blocking layer containing at least silicon and a Group 13 element in the periodic table;

as a second step, first taking out of the film forming furnace the substrate on which the first layer has been deposited, and then;

as a third step, removing protuberances at least at their vertexes on the surface of the first layer deposited in the first step;

as a fourth step, placing the substrate having been subjected to the third step in a film forming furnace having an evacuation means and a source gas feed means and capable of being made vacuum-airtight, and subjecting the surface of the first-layer to plasma treatment with a gas composed of a source gas for feeding a Group 13 element in the periodic table and a dilution gas composed of at least one selected from the group consisting of hydrogen, argon and helium; and as a fifth step, decomposing at least a source gas by a high frequency power to deposit on the first layer a layer formed of a non-single-crystal material as a second layer.

2. The process for producing a negative charging electrophotographic photosensitive member according to claim 1, wherein said first step further comprises the step of forming on the outermost surface of said first layer a protective layer formed of a non-single-crystal material containing at least silicon.

3. The process for producing a negative charging electrophotographic photosensitive member according to claim 2, wherein the steps of forming said upper-part blocking layer and said protective layer which are embraced in said first layer and forming said second layer are each a step of forming a layer formed of a non-single-crystal material containing at least carbon and silicon.

4. The process for producing a negative-charging electrophotographic photosensitive member according to claim 3, wherein the step of forming said upper-part blocking layer comprises increasing toward the surface side a compositional ratio of carbon to silicon which constitute the upper-part blocking layer.

5. The process for producing a negative-charging electrophotographic photosensitive member according to claim 1, wherein the step of forming said second layer is a step of forming a layer formed of a non-single-crystal material composed primarily of carbon atoms.

6. The process for producing a negative-charging electrophotographic photosensitive member according to claim 1, wherein the step of forming said upper-part blocking layer is a step in which a flow rate of a gas containing the Group 13 element in the periodic table used in depositing said upper-part blocking layer is so controlled that the Group 13 element is in a content of 100 atomic ppm or more to 30,000 atomic ppm or less based on the total number of constituent elements contained in said upper-part blocking layer.

7. The process for producing a negative-charging electrophotographic photosensitive member according to claim 1, wherein in said fourth step the content of said Group 13 element of the periodic table in all of the gases used in the plasma treatment; which includes the gas including the source gas and the dilution gas, is controlled as to be in a content of from $2.0\times10^{-4}$ mol % or more to $2.0\times10^{-2}$ mol % or less.

8. The process for producing a negative-charging electrophotographic photosensitive member according to claim 1, wherein in said fourth step, the source gas for feeding the Group 13 element of the periodic table is $B_2H_6$ gas.

9. The process for producing a negative-charging electrophotographic photosensitive member according to claim 1, wherein in said third step, the step of removing protuberances at least at their vertexes on the surface of the first layer is polishing.

10. The process for producing a negative-charging electrophotographic photosensitive member according to claim 1, wherein in said third step, treatment of bringing the surface of said first layer into contact with water is carried out prior to said fourth.

11. A negative-charging electrophotographic photosensitive member which comprises a cylindrical substrate having at least a conductive surface, a first layer formed thereon comprising a photoconductive layer formed of at least a non-single-crystal material, an upper-part blocking layer formed of at least a non-single-crystal material containing carbon and silicon and a protective layer, and a second layer formed on the first layer of at least a non-single-crystal material, wherein (a) an abnormal-growth portion in the first layer does not reach the second layer, and content distribution of a Group 13 element in the periodic table has a peak in an interfacial region between the first layer and the second layer;

(b) a compositional ratio of carbon to silicon which constitute said upper-part blocking layer increases toward the surface side; and (c) the peak of the content distribution of the Group 13 element of the periodic table in the interfacial region between said first layer and said second layer corresponds to from $5.0\times10^{17}$ atoms/cm$^3$ or more to $1.0\times10^{21}$ atoms/cm$^3$ or less.

* * * * *

UNITED STATES PATENT AND TRADEMARK OFFICE

CERTIFICATE OF CORRECTION

PATENT NO. : 7,229,730 B2
APPLICATION NO. : 11/340729
DATED : June 12, 2007
INVENTOR(S) : Jun Ohira et al.

It is certified that error appears in the above-identified patent and that said Letters Patent is hereby corrected as shown below:

COLUMNS 27-29:

Tables 10-14, “>” (all occurrences) should read --→--.

COLUMN 31:

Table 18, “conditions” should read --Experimental conditions--.

Signed and Sealed this

Eighth Day of December, 2009

David J. Kappos

David J. Kappos
*Director of the United States Patent and Trademark Office*